US011336028B2

(12) United States Patent
Shen et al.

(10) Patent No.: US 11,336,028 B2
(45) Date of Patent: May 17, 2022

(54) BUTLER-BASED QUASI-OMNI MIMO ANTENNA

(71) Applicant: COMMUNICATION COMPONENTS ANTENNA INC., Kanata (CA)

(72) Inventors: Lin-Ping Shen, Ontario (CA); Seyed Hamidreza Jamali, Ontario (CA)

(73) Assignee: COMMUNICATION COMPONENTS ANTENNA INC, Kanata (CA)

( * ) Notice: Subject to any disclaimer, the term of this patent is extended or adjusted under 35 U.S.C. 154(b) by 220 days.

(21) Appl. No.: 16/441,858

(22) Filed: Jun. 14, 2019

(65) Prior Publication Data

US 2020/0395674 A1 Dec. 17, 2020

(51) Int. Cl.

| | |
|---|---|
| ***H01Q 21/00*** | (2006.01) |
| ***H01Q 25/00*** | (2006.01) |
| ***H01Q 1/24*** | (2006.01) |
| ***H01Q 21/20*** | (2006.01) |
| ***H01Q 1/42*** | (2006.01) |
| ***H01Q 3/40*** | (2006.01) |
| ***H01Q 5/40*** | (2015.01) |
| ***H01Q 15/14*** | (2006.01) |
| ***H01Q 21/24*** | (2006.01) |
| ***H01Q 21/26*** | (2006.01) |
| ***H01Q 19/10*** | (2006.01) |

(52) U.S. Cl.

CPC ..... *H01Q 21/0006* (2013.01); *H01Q 1/246* (2013.01); *H01Q 1/42* (2013.01); *H01Q 3/40* (2013.01); *H01Q 5/40* (2015.01); *H01Q 15/14* (2013.01); *H01Q 19/108* (2013.01); *H01Q 21/205* (2013.01); *H01Q 21/24* (2013.01); *H01Q 21/26* (2013.01); *H01Q 25/00* (2013.01)

(58) Field of Classification Search

CPC H01Q 1/246; H01Q 1/42; H01Q 3/40; H01Q 5/40; H01Q 15/14; H01Q 19/108; H01Q 21/0006; H01Q 21/24; H01Q 21/26; H01Q 25/00

See application file for complete search history.

(56) References Cited

U.S. PATENT DOCUMENTS

2013/0265197 A1* 10/2013 Jones ..... H01Q 21/08 342/373
2017/0244176 A1* 8/2017 Ming ..... H01Q 1/42

* cited by examiner

*Primary Examiner* — Robert Karacsony

(57) ABSTRACT

An omnidirectional MIMO antenna system includes a multi-panel antenna, each panel including a plurality of antenna elements and a plurality of beam forming networks employing Butler matrices. Each Butler matrix has the same number of input ports and output ports. The total number of the input ports of the Butler matrices is equal to the number of ports of the MIMO antenna, each of the input ports receiving the same signal. Each of the output ports of each of the Butler matrices is coupled to an antenna element within the plurality of the antenna elements, such that the multi-panel antenna exhibits a quasi-omnidirectional beam pattern.

8 Claims, 26 Drawing Sheets

Perspective View of 6x6 MIMO Omni-directional Antenna

Cross-section View

Perspective View of 2x2 MIMO Omni-directional Antenna

Cross-section View

Perspective View of 6x6 MIMO Omni-directional Antenna

Cross-section View

Perspective View of 12x12 MIMO Omni-directional Antenna

Cross-section View

Perspective View of 12x12 MIMO Omni-directional Antenna

Cross-section View

Perspective View of 12x12 MIMO Omni-directional Antenna

Cross-section View

Perspective View of 8x8 MIMO Omni-directional Antenna

Cross-section View

Perspective View of 8x8 MIMO Omni-directional Antenna

Cross-section View

Perspective View of 6x6 MIMO Omni-directional Antenna

Cross-section View

Side View

Butler 2x2

Butler 3x3

Butler 4x4

Butler 4x4

Butler 3x3

Butler 2x2

Butler 3x3

Butler 3x3

Butler 3x3

BUTLER-BASED QUASI-OMNI MIMO ANTENNA

FIELD OF THE INVENTION

This invention relates to a quasi omni-directional MIMO antenna and a system and method for an optimized beam forming for the antenna.

BACKGROUND

With the ever increasing demand for link capacity and spectral efficiency, current cellular networks are relying on better antenna technology to meet the demands. One area of promising performance in antenna design is the use of multiple-input, multiple-output (MIMO) antennas. MIMO is effectively a radio antenna technology that uses multiple antennas at the transmitter and receiver to enable a variety of signal paths to carry the same data, choosing separate paths for each antenna enabling the use of multiple signal paths for a better throughput.

FIG. 1 illustrates a MIMO communication system. Transmitter 10, along with Receiver 12 includes multiple antennas. As illustrated between the transmitter and the receiver, the signal can take many paths. Additionally, by moving the antennas even a small distance the signal paths would change. The variety of paths available occurs as a result of the number of objects that appear to the side or even in the direct path between the transmitter and receiver. These multi paths can introduce signal interference and fading. Therefore, by using MIMO, the additional signal paths can be used to improve the performance of the communication system. By sending the same signal through multiple antennas, the multiple signal paths can be used to provide additional robustness to the radio link by improving the signal to noise ratio, and by increasing the link data capacity.

In order to be able to implement a communications network based on MIMO antennas, it is necessary to implement various coding techniques to separate the data from the different paths. This requires additional processing capabilities in the transmitter as well in the receiver, but provides additional channel robustness and data throughput capacity.

Referring to FIG. 1 again, $r_1, r_2, \ldots r_n$ refer to the signal received at each corresponding antenna of receiver 12. Furthermore, $t_1, t_2, \ldots t_m$ refer to the signal transmitted from each corresponding antenna of transmitter 10. Finally, $h_{ji}$ refers to the channel characteristic between transmitter i and receiver j (i=1,2, . . . , m and j=1,2, . . . , n).

In matrix format this can be represented as:

$$[R]=[H]\times[T]$$

To recover the transmitted data stream at the receiver it is necessary to perform a considerable amount of signal processing. First the MIMO system decoder must estimate the individual channel transfer characteristic $h_{ji}$ to determine the channel transfer matrix. Once all of this has been estimated, then the matrix [H] is estimated and the transmitted data streams can be reconstructed by multiplying the received vector with the inverse of the transfer matrix.

$$[T]=[H]^{-1}\times[R]$$

This process can be likened to the solving a set of N linear simultaneous equations (i.e., N=m*n) to reveal the values of N variables.

FIGS. 2A and 2B illustrate a prior art multi-column cellular base antenna structure 20 with three panels 22, 24, and 26 that can be used in a cellular communications network to provide a quasi-omnidirectional pattern in a given cell of a cellular network. FIG. 2B is a perspective view of the MIMO antenna, whereas FIG. 2A is a cross section view of the antenna.

Antenna 20 includes two T-splitter type beam forming networks (BFN) 28 and 30, each configured to receive one port of the two port MIMO structure. Each BFN 28 and 30 receives the same signal and through combining its three outputs of panels 22, 24, and 26 equally realizes one omni-directional pattern with 360 degree coverage. The antenna structure provides dual polarizations (+45 and −45 degree) resulting in a 2×2 MIMO arrangement.

Although FIG. 2 illustrates a three-panel antenna, any number of panels that can cover 360° area of a cell can be used so as to provide an omni-directional signal pattern. However, as the number of ports increases, additional number of panels becomes necessary. For example, for a 4 port 4×4 MIMO antenna system, the arrangement shown in FIG. 2 is modified to include a hexagonal structure with six panels. The system would include 4 T-splitter type Beam forming networks with one input and three outputs each. A total of 12 outputs provide signals to 24 antenna elements, four of each located on each panel of the hexagonal structure.

In general, with the prior art systems, the dual polarization quasi-omni MIMO antenna requires a defined number of columns in a circular architecture with 3N columns for 2N ports, where N is a non-zero integer. One constraint with making additional panels is that, in order to have the same radome enclosure as the currently existing cellular antennas with two ports, the total radius of the MIMO antenna cannot expand much to accommodate the additional number of panels that are necessary with additional ports. In order to involve more ports in the small enclosure, the width of the column panel must be reduced significantly. However, due to the strong coupling between columns, both return loss (RL) and isolation (ISO) degrade substantially.

Hence, there is a need for a quasi-omnidirectional MIMO antenna system with multiple columns that can accommodate a substantially high number of ports, while maintaining an acceptable return loss (RL) and isolation (ISO) between the ports in each column.

OBJECTS AND SUMMARY

In accordance with various embodiments of the invention, a (2m)N×(2m)N omnidirectional MIMO antenna system is configured, where m is integer larger than 1 and N is integer equal to or larger than 1, wherein the antenna system includes mN columns of antenna elements forming a circular array, with each column including a number of antenna elements. In order to form a circular array, the MIMO antenna system has at least two columns. The number of antenna elements in each column depends on the desired antenna gain as well as a desired antenna elevation pattern. For mN columns, a plurality of m×m butler matrices are each configured based on a desired beam forming network so as to provide a quasi-omnidirectional (2m)N×(2m)N MIMO antenna pattern. Again, for mN columns, the number of the butler matrices is 2N.

As such, for a mN column MIMO antenna forming a circular antenna array, where m is 2 and N is at least 1, the antenna system includes 2N columns or panels, with 2N Butler matrices each with a 2×2 configuration to realize a 4N×4N MIMO antenna system.

In another example, for a mN column MIMO antenna forming a circular antenna array, where m is 3, the antenna system includes 3N columns or panels with 2N Butler matrices each with a 3×3 configuration to realize a 6N×6N MIMO antenna system.

In yet another example, for a mN column MIMO antenna forming a circular antenna array where m is 4, the antenna system includes 4N columns or panels with 2N Butler matrices each with a 4×4 configuration to realize an 8N×8N MIMO antenna system.

In accordance with yet another embodiment of the invention, a 2(m−1)N×2(m−1)N MIMO omnidirectional antenna system is configured, where m is integer larger than 2 and N is integer equal to or larger than 1, wherein the antenna system includes mN columns of antenna elements forming a circular array, with each column including a number of antenna elements. In order to form a circular array, the MIMO antenna system has at least two columns. The number of antenna elements in each column depends on the desired antenna gain as well as a desired antenna elevation pattern. For mN columns, a plurality of (m−1)×m Butler matrices are each configured based on a desired beam forming network so as to provide a quasi-omnidirectional 2(m−1)N×2(m−1)N MIMO antenna pattern. Again for mN columns, the number of the Butler matrices is 2N. In accordance with this embodiment of invention, for a mN column MIMO antenna featuring a circular antenna array, where m is 4 and N is 1, the antenna system include 4 columns or panels, with 2 Butler matrices each with a 3×4 configuration to realize a 6×6 MIMO antenna system.

The above examples illustrate some of the advantages of the invention. For example, the quasi-omnidirectional MIMO antenna system in accordance with various embodiments allows for a flexible design, where compared to previous designs, the necessary number of columns or panels can be substantially reduced for even a high number of antenna ports. This flexibility in antenna design can accommodate for advances in transmission and receiver technology with ever more complex processors to increase the number of MIMO elements without sacrificing the limited space that the antenna radomes can occupy within the existing cellular antenna architectures.

BRIEF DESCRIPTION OF DRAWINGS

The appended claims particularly point out and distinctly claim the subject matter of this invention. The various objects and advantages of the present invention will be more fully apparent upon reading the following description in conjunction with the accompanying drawings in which:

DETAILED DESCRIPTION

As explained before, one of the advantages of the invention as claimed and described herein, is to reduce the number of necessary reflector panels, and hence resolve the RL (return loss) and ISO (isolation) issues for the same number of ports in a multi-port MIMO antenna. One way to achieve this result is to employ a uniquely designed Butler matrix beam forming network (BFN) that replaces the traditional T-splitter BFNs to increase the number of input ports without increasing the number of the necessary reflector panels. In other words, for the same size of the antenna, the number of input ports is increased significantly by replacing the traditional T-splitter with new proposed Butler matrix type BFN as described here.

Figure 3A:
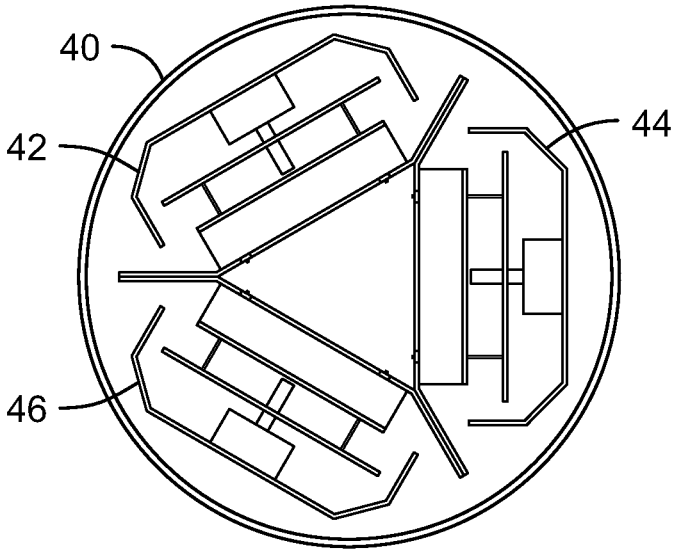
FIGS. 3A is a cross section view of a three-column 6×6 MIMO cellular base antenna structure with two 3×3 Butler matrix configuration and FIG. 3B is a perspective view of the antenna.
Figure 3B:
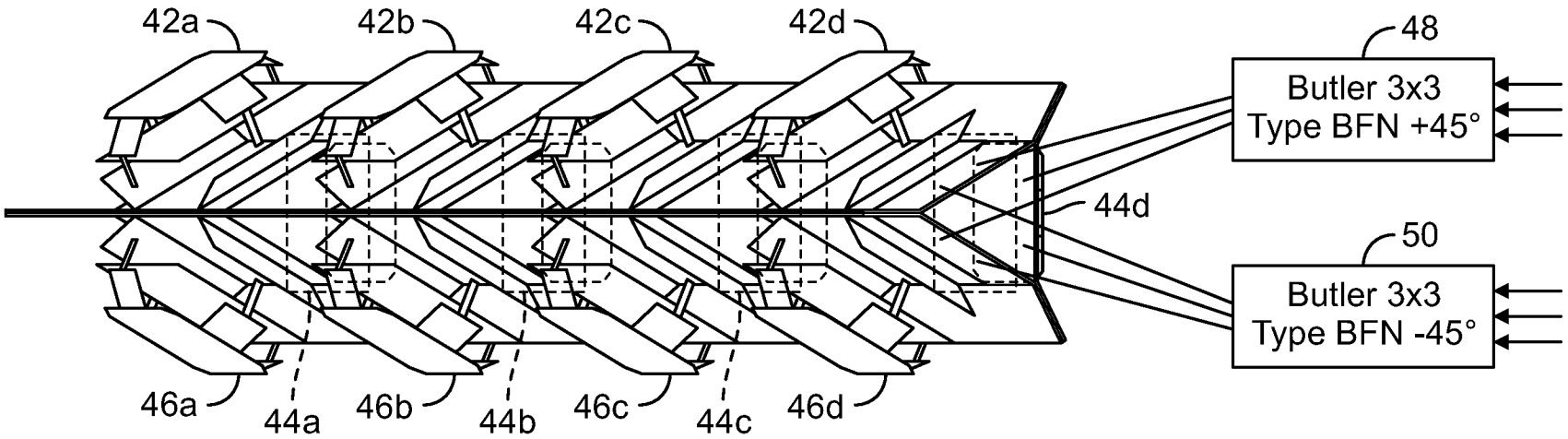

To this end, in accordance with one embodiment of the invention, FIGS. 3A and 3B illustrate a MIMO antenna in accordance with one embodiment of the invention. As illustrated in FIG. 3A, a cellular base antenna structure 40 with three panels 42, 44, and 46 are employed to provide a quasi-omnidirectional communications signal pattern in a given cell of a cellular network. FIG. 3B is a perspective view of the MIMO antenna, whereas FIG. 3A is a cross section view of the antenna.

Antenna 40 includes two 3×3 Butler type beam forming network (BFN) 48 and 50, each configured to receive three ports of a six port MIMO structure. Each BFN 48 and 50 receives the same signal from three panels 42, 44, and 46 and through its three outputs provides three signals so as to realize three omni-directional patterns with 360 degree coverage. The antenna structure provides dual polarizations (+45 and −45 degree) resulting in a 6×6 MIMO arrangement.

Each panel 42, 44, and 46 includes four antenna elements, which in accordance with one embodiment of the invention are patch elements, as illustrated in FIGS. 3, although other types of antennas elements can be used as well. Generally, patch elements are used more frequently for small radius antennas. To this end, panel 42 includes antenna elements 42*a* through 42*d*, panel 44 includes antenna elements 44*a* through 44*d* and panel 46 includes antenna elements 46*a* through 46*d*.

In accordance with one embodiment of the invention, beam forming network (BFN) 48 provides the corresponding signal to three positive ports on each panel 42, 44, and 46. Similarly beam forming network (BFN) 50 provides a corresponding signal to the remaining three negative ports on each panel 42, 44, and 46 so as to accomplish a dual polarization arrangement.

Figure 1:
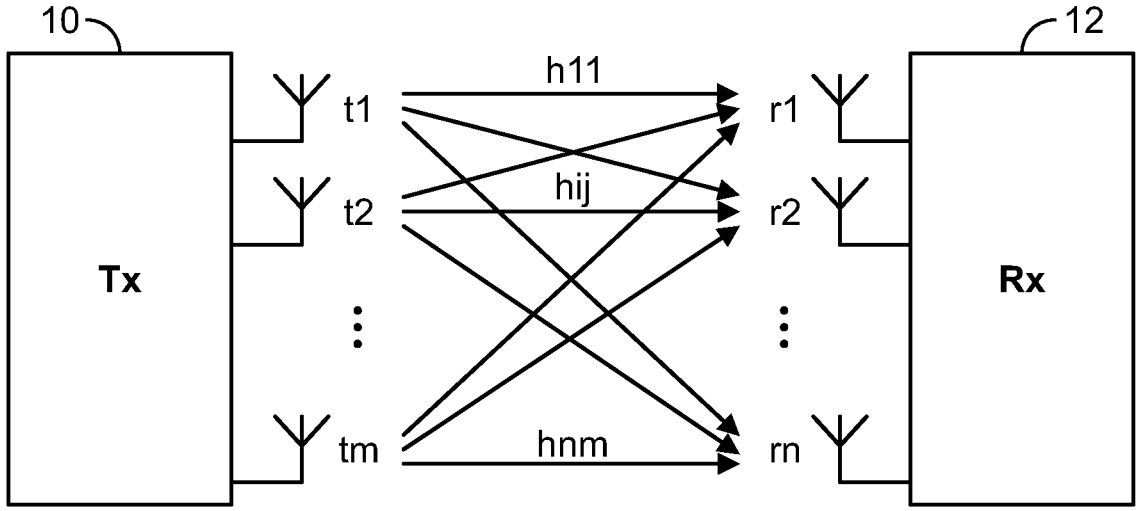
FIG. 1 is a diagrammatic view of the general MIMO communication system.
Figure 2A:
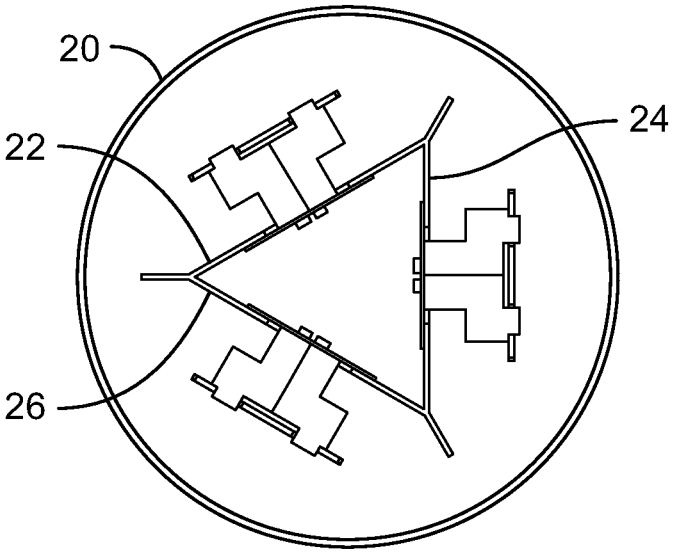
FIG. 2A (Prior Art)
FIG. 2A is a cross section view of a prior art three-column 2×2 MIMO cellular base antenna structure and FIG. 2B is a perspective view of the antenna.
Figure 2B:
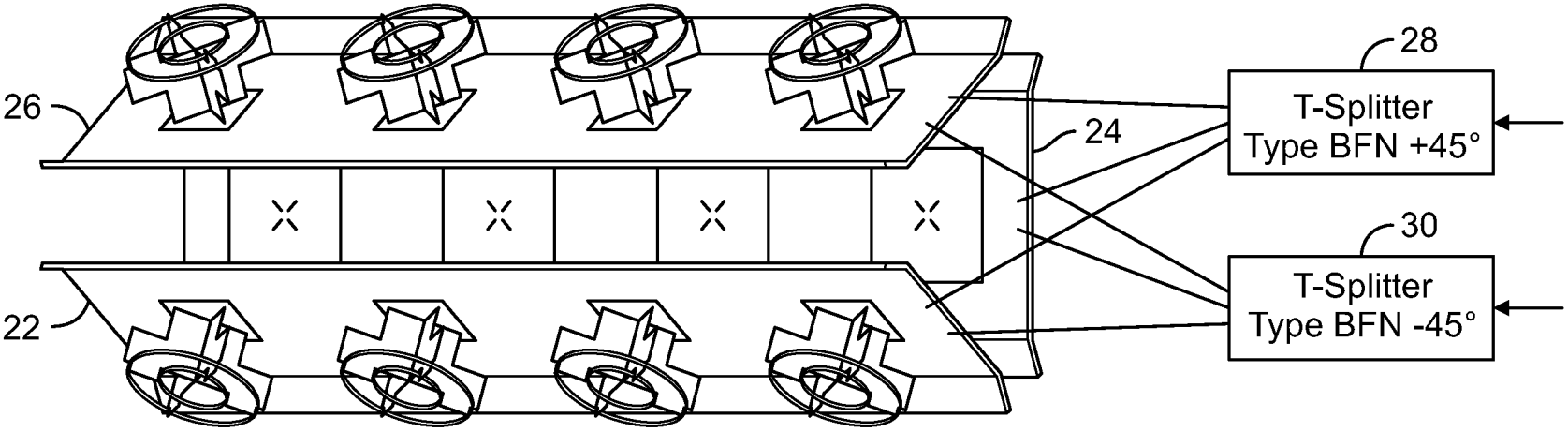
FIG. 2B (Prior Art)

As illustrated and explained in reference with FIG. 3A and FIG. 3B the present embodiment allows a construction of a 6×6 MIMO in the same space as previously accomplished for a 2×2 MIMO illustrated in FIGS. 2A and 2B.

Figure 4A:
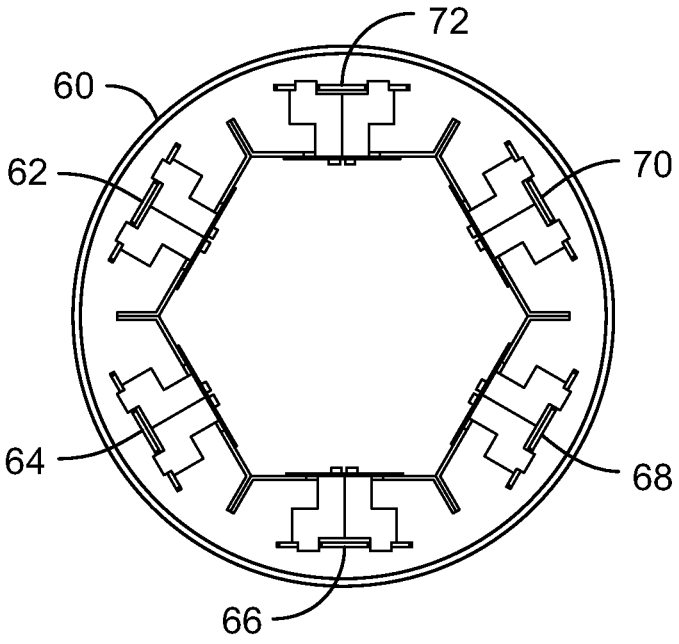
FIGS. 4A is a cross section view of a six-column 12×12 MIMO cellular base antenna structure with four 3×3 Butler matrix configuration and FIG. 4B is a perspective view of the antenna.
Figure 4B:
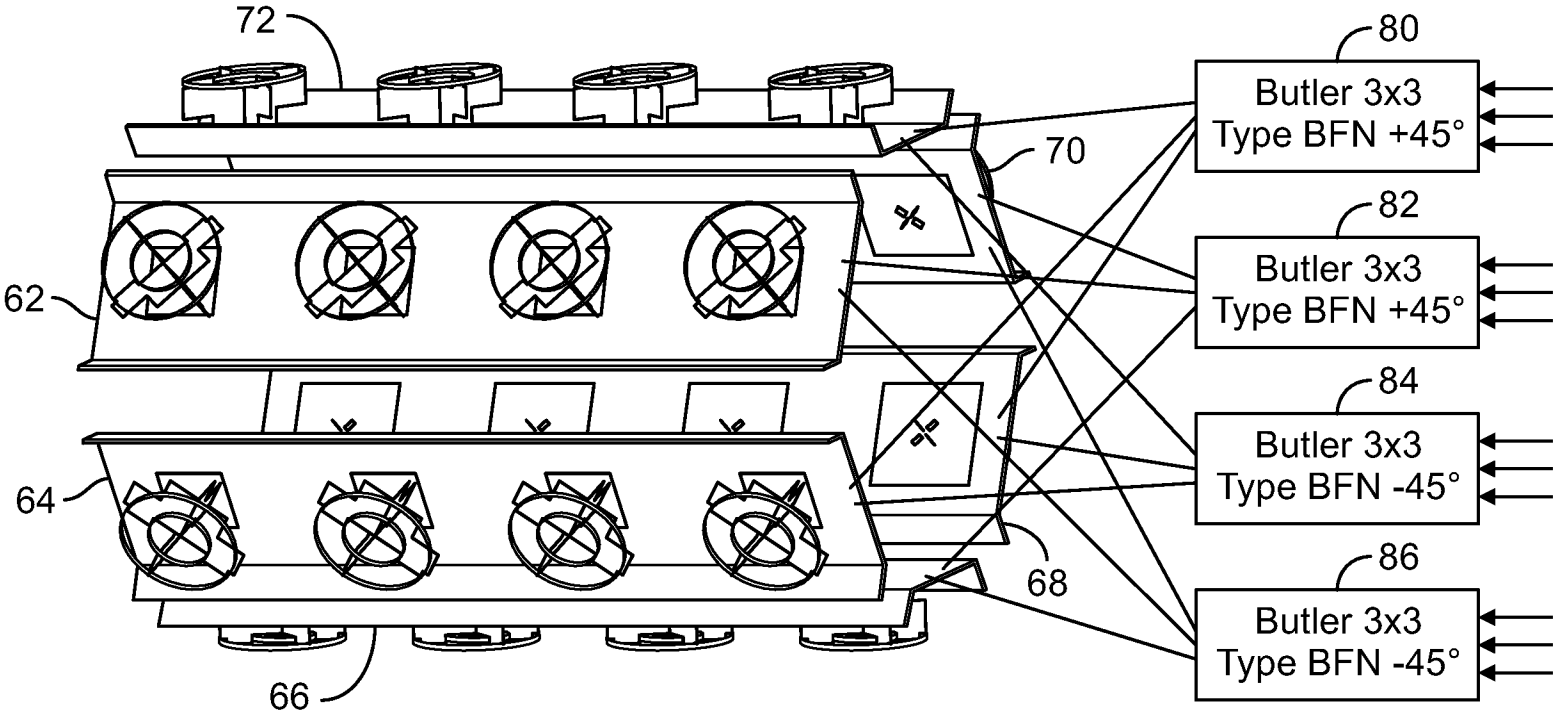

In accordance with another embodiment of the invention, FIGS. 4A and 4B illustrate a 12×12 MIMO antenna occupying the same space as previously provided for a 4×4 MIMO antenna in accordance with the system described in reference that is similar with FIGS. 2A and 2B.

As illustrated in FIG. 4A, a cellular base antenna structure 60 with six panels 62, 64, 66, 68, 70, and 72 are employed to provide a quasi-omnidirectional pattern in a given cell of a cellular network. FIG. 4B is a perspective view of the MIMO antenna, whereas FIG. 4A is a cross section view of the antenna.

Antenna 60 includes four 3×3 Butler type beam forming network (BFN) 80, 82, 84, and 86 each configured to receive three ports of a 12 port MIMO structure. Each BFN 80, 82, 84, and 86 receives the same signal from three panels and through its three outputs provides three signals so as to realize three different omni-directional patterns with 360 degree coverage. The antenna structure provides dual polarizations (+45 and −45 degree) resulting in a 12×12 MIMO arrangement.

Each panel 62 through 72 includes four antenna elements (i.e., the dipole elements). To this end, panel 62 includes antenna elements 62*a* through 62*d*, panel 64 includes antenna elements 64*a* through 64*d*, panel 66 includes antenna elements 66*a* through 66*d*, panel 68 includes antenna elements 68*a* through 68*d*, panel 70 includes antenna elements 70*a* through 70*d* and panel 72 includes antenna elements 72*a* though 72*d*.

In accordance with one embodiment of the invention, beam forming networks (BFN) 80 and 84 provide signals to ±45 degree polarization ports of three panels 64, 68, and 72 and beam forming networks (BFN) 82 and 86 provide signals to ±45 degree polarization ports of three panels 62, 66, and 70, so as to accomplish a dual polarization arrangement.

Advantageously, in accordance with this embodiment of the invention in reference with FIGS. 4A and 4B, it is possible to configure a 12×12 MIMO antenna system in the same space that the prior art systems could at most accommodate a 4×4 MIMO.

Figure 5A:
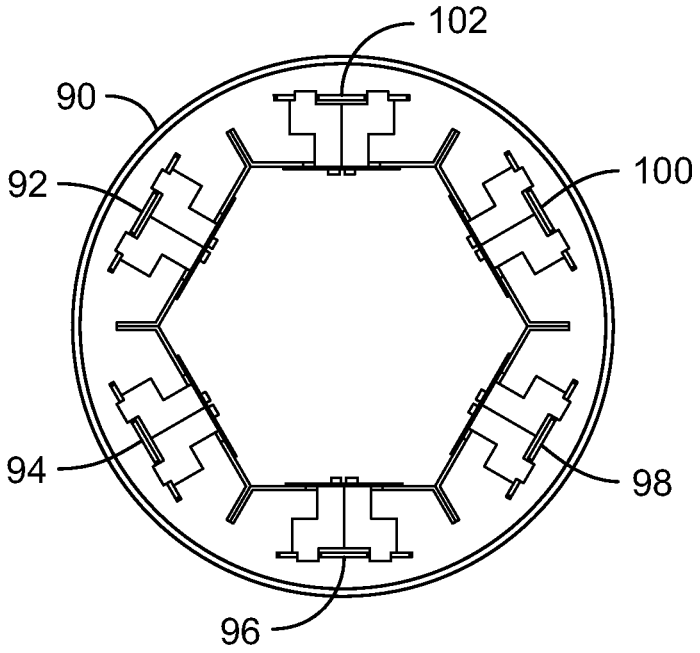
FIGS. 5A is a cross section view of a six-column 12×12 MIMO cellular base antenna structure with six 2×2 Butler matrix configuration and FIG. 5B is a perspective view of the antenna.
Figure 5B:
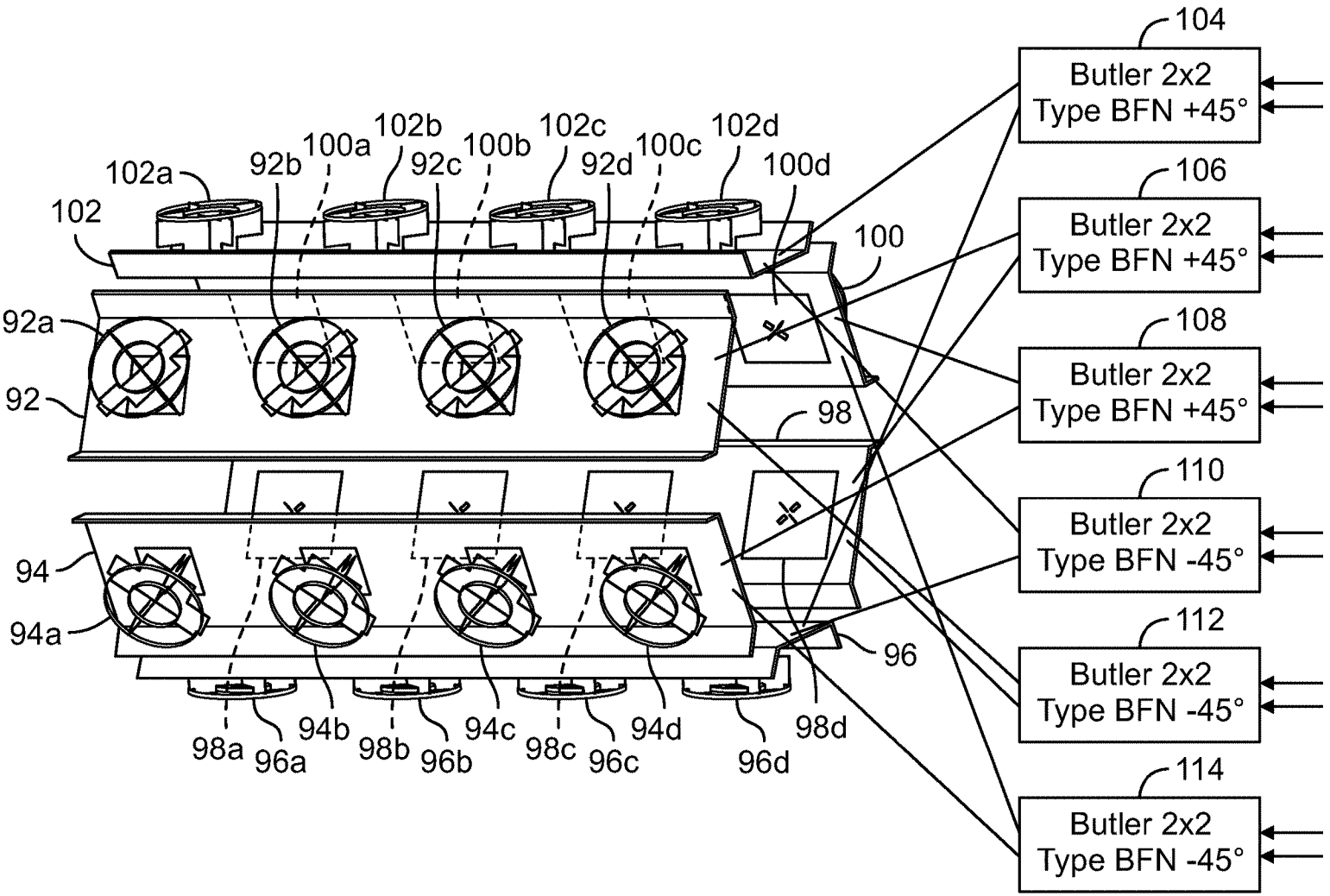

In accordance with another embodiment of the invention, FIGS. 5A and 5B illustrate a 12×12 MIMO antenna occupying the same space as previously provided for a 4×4 MIMO antenna in accordance with the system described in reference with FIGS. 2A and 2B.

As illustrated in FIG. 5A, a cellular base antenna structure 90 with six panels 92, 94, 96, 98, 90, and 100 are employed to provide a quasi-omnidirectional pattern in a given cell of a cellular network. FIG. 5B is a perspective view of the MIMO antenna, whereas FIG. 5A is a cross section view of the antenna.

Antenna 90 includes six 2×2 Butler type beam forming network (BFN) 104, 106, 108, 110, 112, and 114 each configured to receive two ports of a 12 port MIMO structure. Each BFN 104, 106, 108, 110, 112, and 114 receives the same signal from two panels and through its two outputs provides two signals so as to realize two different omni-directional patterns with 360 degree coverage. The antenna structure provides dual polarizations (+45 and −45 degree) resulting in a 12×12 MIMO arrangement.

Each panel 92 through 102 includes four antenna elements. To this end, panel 92 includes antenna elements 92*a* through 92*d*, panel 94 includes antenna elements 94*a* through 94*d*, panel 96 includes antenna elements 96*a* through 96*d*, panel 98 includes antenna elements 98*a* through 98*d*, panel 100 includes antenna elements 100*a* through 100*d*, and panel 102 includes antenna elements 102*a* though 102*d*.

In accordance with one embodiment of the invention, beam forming networks (BFN) 104 and 110 provide signals to ±45 degree polarization ports of two panels 96 and 102, beam forming networks (BFN) 106 and 112 provide signals to ±45 degree polarization ports of two panels 92 and 98, and beam forming networks (BFN) 108 and 114 provide signals to ±45 degree polarization ports of two panels 94, and 100, so as to accomplish a dual polarization arrangement.

Advantageously, in accordance with this embodiment of the invention in reference with FIGS. 5A and 5B, it is possible to configure a 12×12 MIMO antenna system in the same space that the prior art systems could at most accommodate a 4×4 MIMO.

Figure 6A:
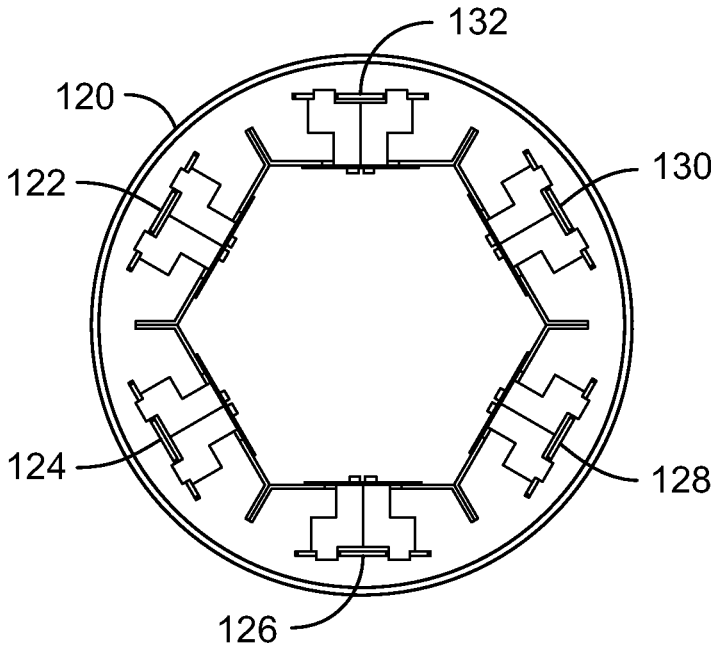
FIGS. 6A is a cross section view of a six-column 12×12 MIMO cellular base antenna structure with two 6×6 Butler matrix configuration and FIG. 6B is a perspective view of the antenna.
Figure 6B:
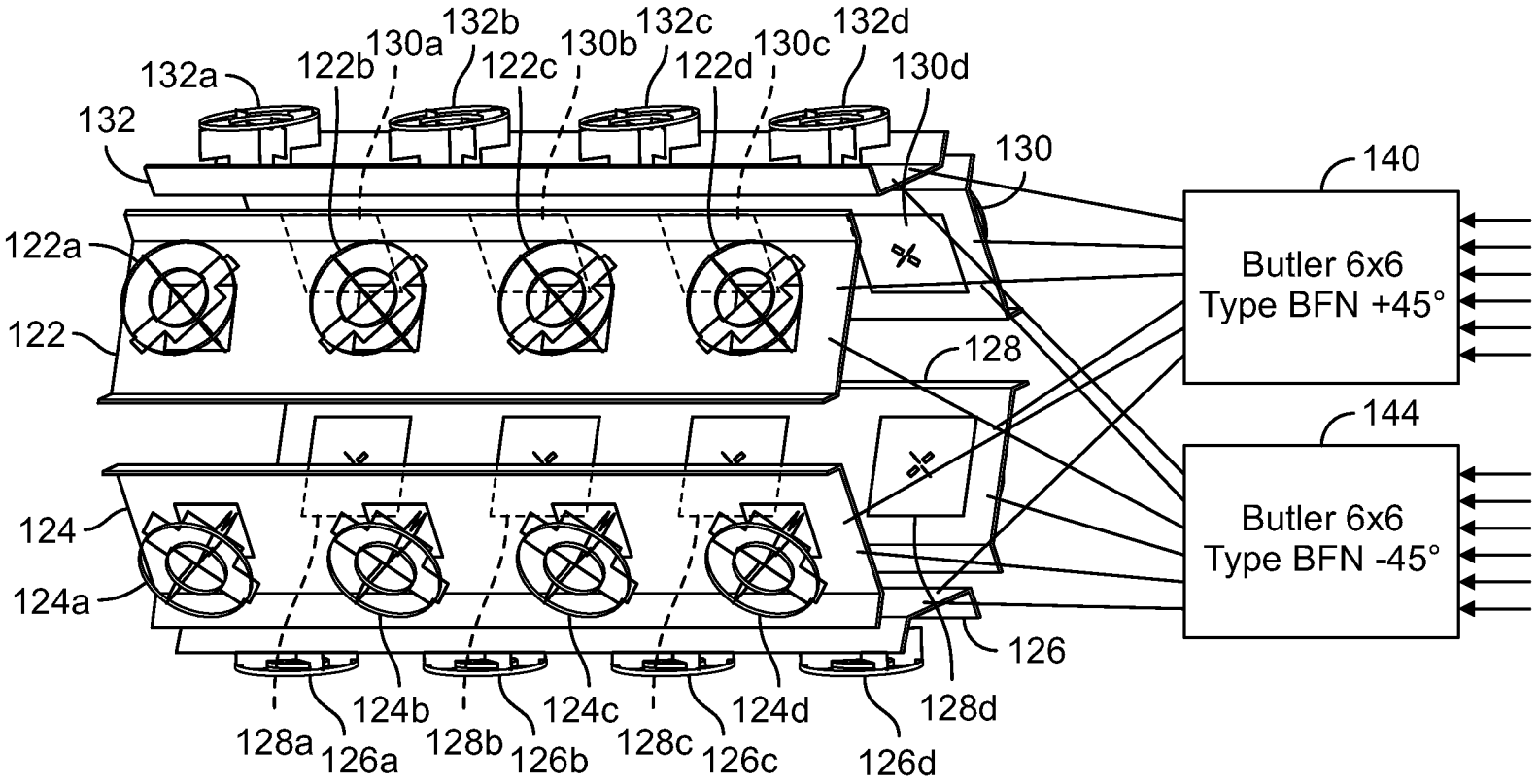

In accordance with another embodiment of the invention, FIGS. 6A and 6B illustrate another system for implementing a 12×12 MIMO antenna occupying the same space as previously provided for a 4×4 MIMO antenna in accordance with the system described in reference with FIGS. 2A and 2B.

As illustrated in FIG. 6A, a cellular base antenna structure 120 with six panels 122, 124, 126, 128, 130, and 132 are employed to provide a quasi-omnidirectional pattern in a given cell of a cellular network. FIG. 6B is a perspective view of the MIMO antenna, whereas FIG. 6A is a cross section view of the antenna.

Antenna 120 includes two 6×6 Butler type beam forming network (BFN) 140 and 144, each configured to receive six ports of a 12 port MIMO structure. Each BFN 140 and 144 receives the same signal from six panels and through its six outputs provides six signals so as to realize six omni-directional patterns with 360 degree coverage. The antenna structure provides dual polarizations (+45 and −45 degree) resulting in a 12×12 MIMO arrangement.

Each panel 122 through 132 includes four antenna elements. To this end, panel 122 includes antenna elements 122*a* through 122*d*, panel 124 includes antenna elements 124*a* through 124*d*, panel 126 includes antenna elements 126*a* through 126*d*, panel 128 includes antenna elements 128*a* through 128*d*, panel 130 includes antenna elements 130*a* through 130*d* and panel 132 includes antenna elements 132*a* through 132*d*.

In accordance with one embodiment of the invention, beam forming network (BFN) 140 provides signals to +45 degree polarization ports of six panels 122 through 132, and beam forming network (BFN) 144 provides signals to −45 degree polarization ports of six panels 122 through 132, so as to accomplish a dual polarization arrangement.

Advantageously, in accordance with this embodiment of the invention in reference with FIGS. 6A and 6B, it is possible to configure a 12×12 MIMO antenna system in the same space that the prior art systems could at most accommodate a 4×4 MIMO.

Figure 7A:
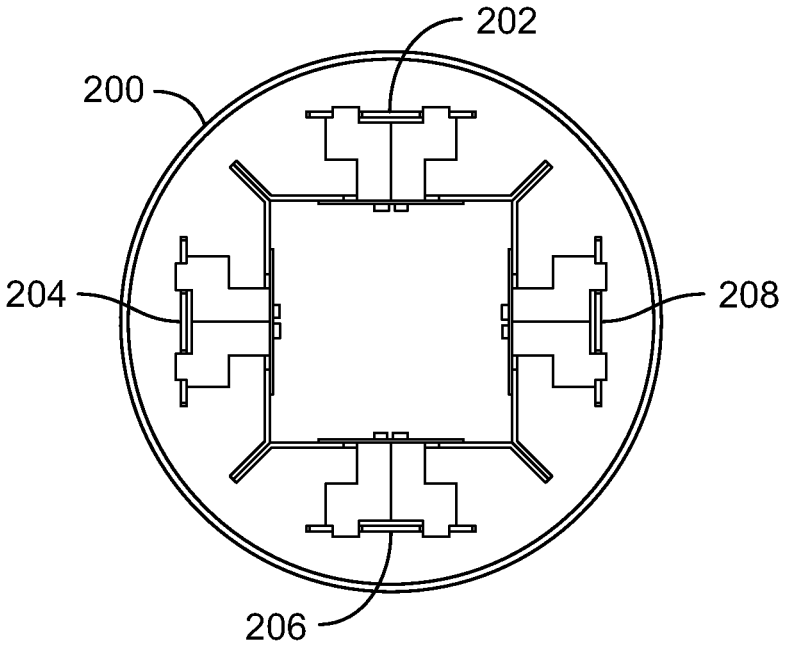
FIGS. 7A is a cross section view of a four-column 8×8 MIMO cellular base antenna structure with two 4×4 Butler matrix configuration and FIG. 7B is a perspective view of the antenna.
Figure 7B:
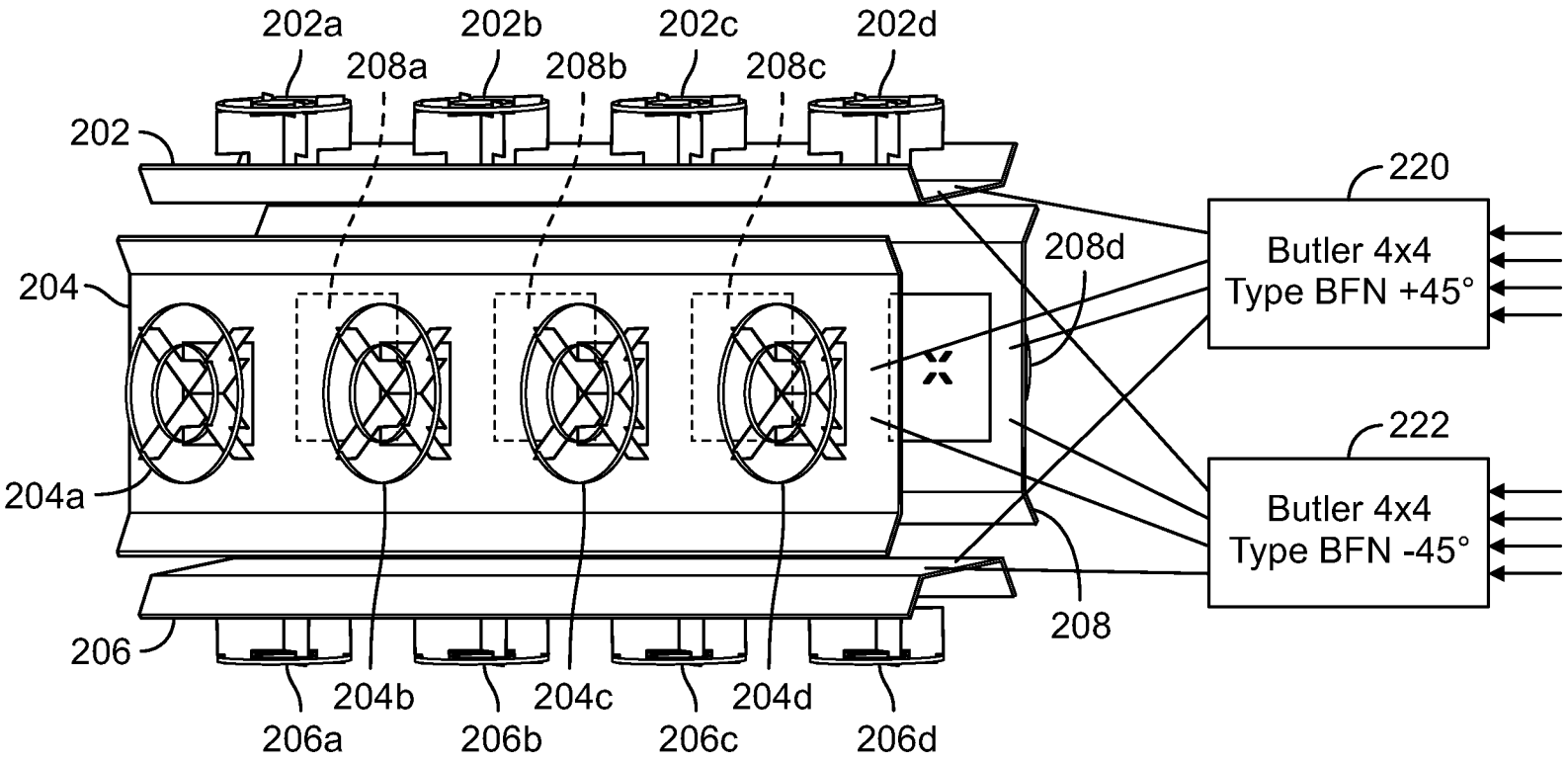

FIGS. 7A and 7B illustrate yet another embodiment of the invention relating to an 8×8 MIMO antenna. As illustrated in FIG. 7A, a cellular base antenna structure 200 with four panels 202, 204, 206, and 208 are employed to provide a quasi-omnidirectional pattern in a given cell of a cellular network. FIG. 7B is a perspective view of the MIMO antenna, whereas FIG. 7A is a cross section view of the antenna.

Antenna 200 includes two 4×4 Butler type beam forming network (BFN) 220 and 222 each configured to receive four ports of an 8 port MIMO structure. Each BFN 220 and 222 receives the same signal from four panels and through its four outputs provides four signals so as to realize four omni-directional patterns with 360 degree coverage. The antenna structure provides dual polarizations (+45 and −45 degree) resulting in an 8×8 MIMO arrangement.

Each panel 202 through 208 includes four antenna elements. To this end, panel 202 includes antenna elements 202*a* through 202*d*, panel 204 includes antenna elements 204*a* through 204*d*, panel 206 includes antenna elements 206*a* through 206*d*, and panel 208 includes antenna elements 208*a* through 208*d*.

In accordance with one embodiment of the invention, beam forming network (BFN) 220 provides signals to +45 degree polarization ports of the four panels 202, 204, 206, and 208, and beam forming networks (BFN) 222 provides signals to −45 degree polarization ports of the four panels 202, 204, 206, and 208, so as to accomplish a dual polarization arrangement.

Advantageously, in accordance with this embodiment of the invention in reference with FIGS. 7A and 7B, it is possible to configure an 8×8 MIMO antenna system in a substantially smaller space than what would have been required for an 8×8 MIMO antenna system in accordance with T-splitter type beam forming networks of the prior art.

Figure 8A:
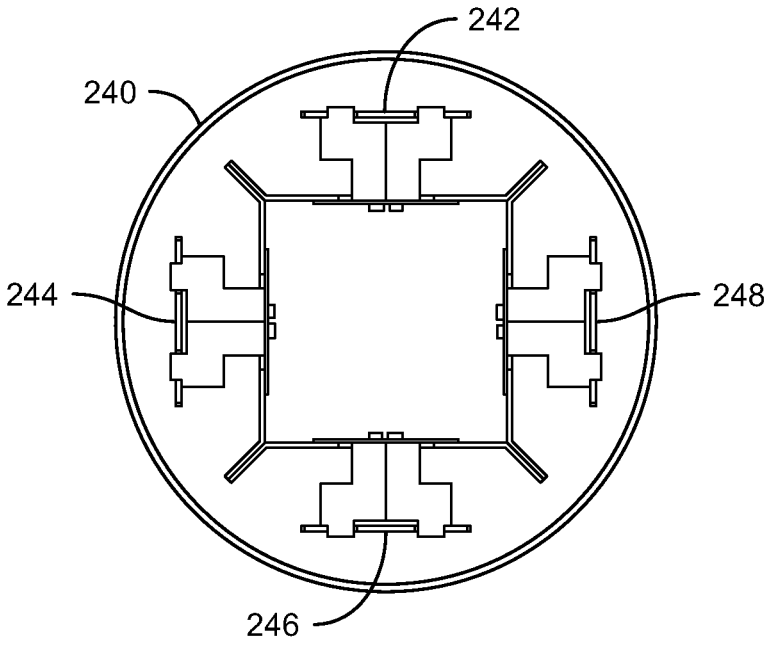
FIGS. 8A is a cross section view of a four-column 8×8 MIMO cellular base antenna structure with four 2×2 Butler matrix configuration and FIG. 8B is a perspective view of the antenna.
Figure 8B:
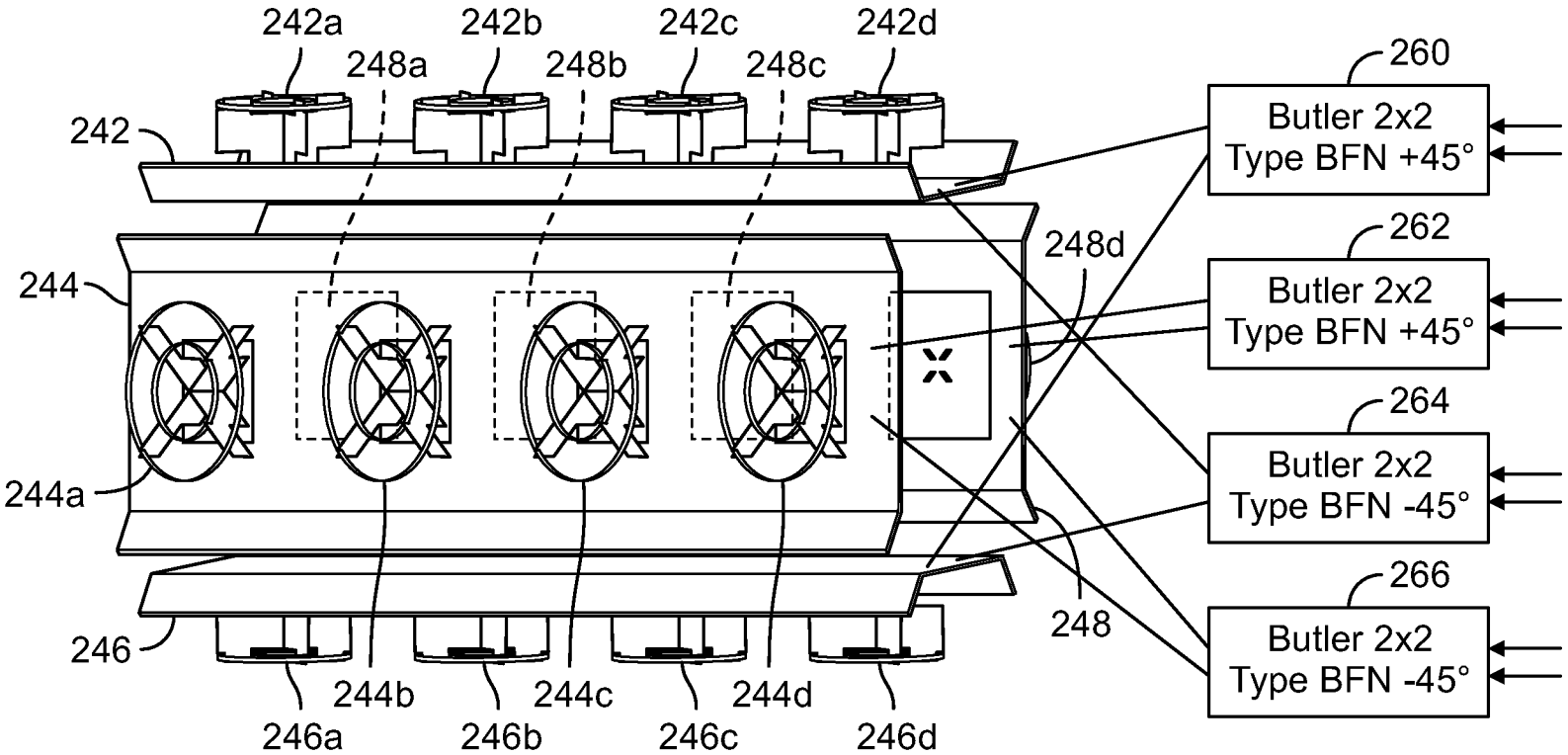

FIGS. 8A and 8B illustrate yet another embodiment of the invention relating to an 8×8 MIMO antenna. As illustrated in FIG. 8A, a cellular base antenna structure 240 with four panels 242, 244, 246, and 248 are employed to provide a quasi-omnidirectional pattern in a given cell of a cellular network. FIG. 8B is a perspective view of the MIMO antenna, whereas FIG. 8A is a cross section view of the antenna.

Antenna 240 includes four 2×2 Butler type beam forming network (BFN) 260, 262, 264, and 266 each configured to receive two ports of an 8 port MIMO structure. Each BFN 260, 262, 264, and 266 receives the same signal from two panels and through its two outputs provides two signals so as to realize two omni-directional patterns with 360 degree coverage. The antenna structure provides dual polarizations (+45 and −45 degree) resulting in an 8×8 MIMO arrangement.

Each panel 242 through 248 includes four antenna elements. To this end, panel 242 includes antenna elements 242*a* through 242*d*, panel 244 includes antenna elements 244*a* through 244*d*, panel 246 includes antenna elements 246*a* through 246*d*, and panel 248 includes antenna elements 248*a* through 248*d*.

In accordance with one embodiment of the invention, beam forming networks (BFN) 260 and 264 provide signals to ±45 degree polarization ports of the two panels 242 and 246, and beam forming networks (BFN) 262 and 266 provide signals to ±45 degree polarization ports of the two panels 244 and 248, so as to accomplish a dual polarization arrangement.

Advantageously, in accordance with this embodiment of the invention in reference with FIGS. 8A and 8B, it is possible to configure an 8×8 MIMO antenna system in a substantially smaller space than what would have been required for an 8×8 MIMO antenna system in accordance with T-splitter type beam forming networks of the prior art for a 2×2 MIMO antenna system.

Figure 9A:
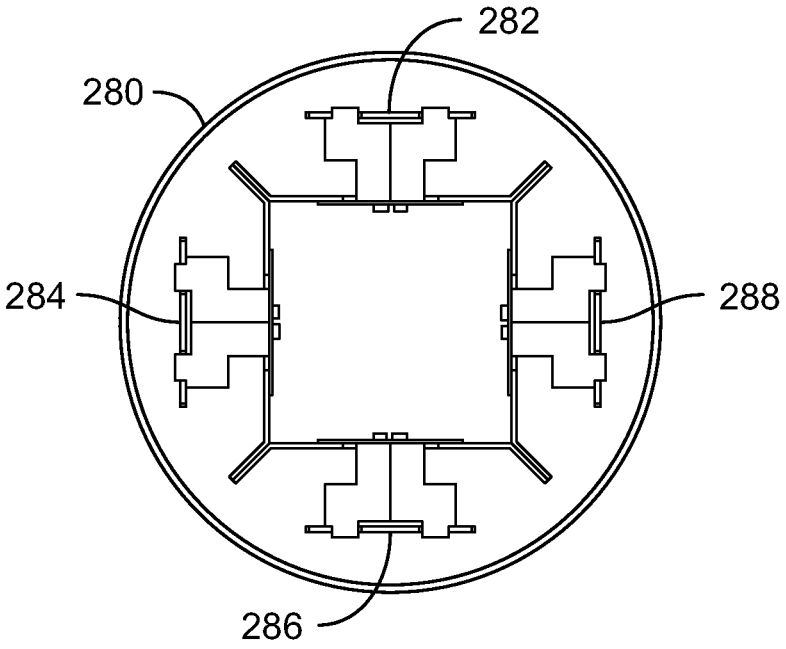
FIGS. 9A is a cross section view of a four-column 6×6 MIMO cellular base antenna structure with two 3×4 Butler matrix configuration and FIG. 9B is a perspective view of the antenna.
Figure 9B:
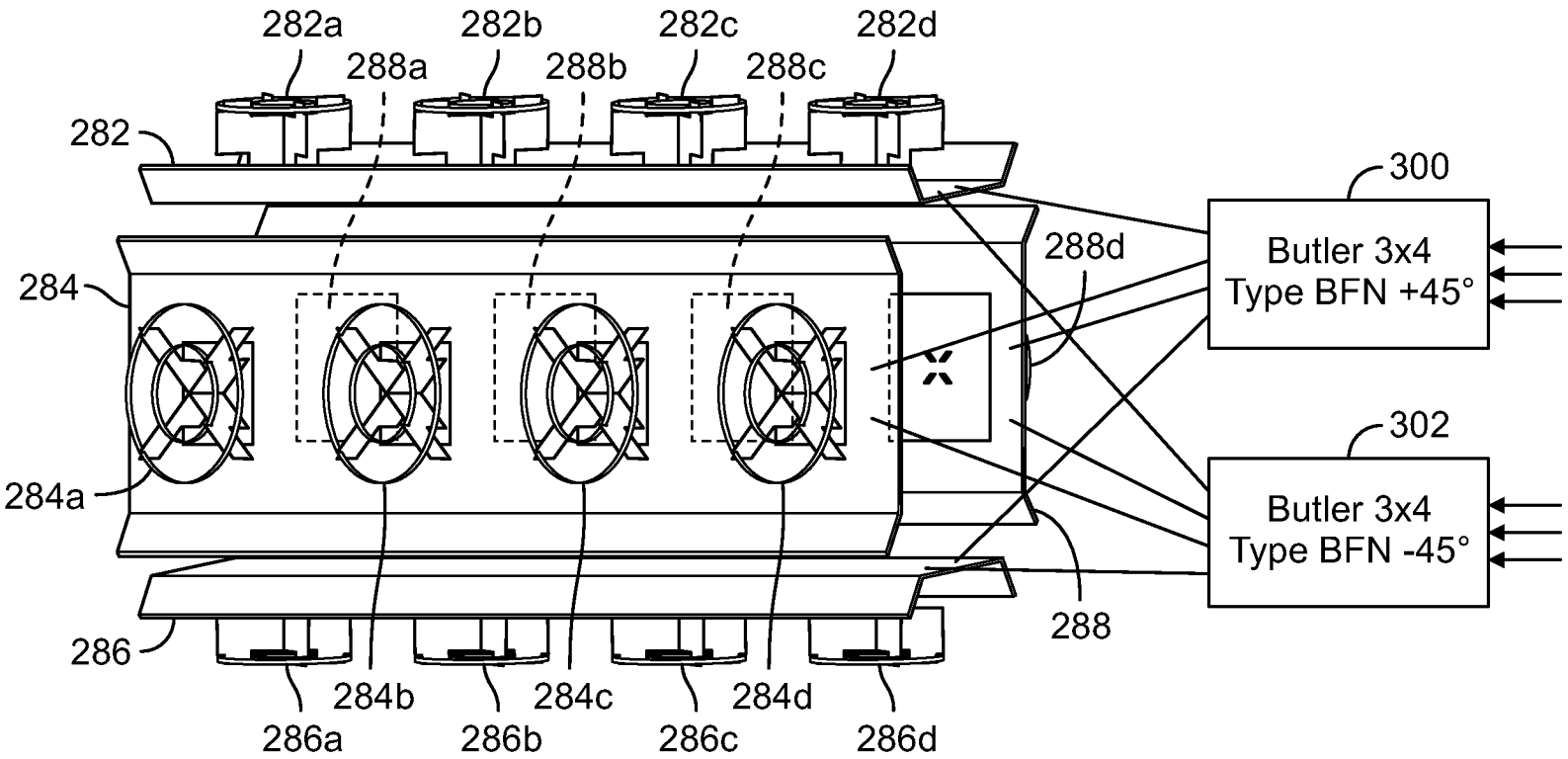

FIGS. 9A and 9B illustrate yet another embodiment of the invention relating to an 6×6 MIMO antenna. As illustrated in FIG. 9A, a cellular base antenna structure 280 with four panels 282, 284, 286, and 288 are employed to provide a quasi-omnidirectional pattern in a given cell of a cellular network. FIG. 9B is a perspective view of the MIMO antenna, whereas FIG. 9A is a cross section view of the antenna. Antenna system 280 advantageously illustrates an exemplary embodiment for a 2(m−1)N×2(m−1)N MIMO antenna with mN panels of four antenna elements fed by 2N beam forming networks of (m−1)×m Butler matrices, wherein m=4 and N=1

Antenna 280 includes two 3×4 Butler type beam forming network (BFN) 300 and 302 each configured to receive three ports of a six port MIMO structure. Each BFN 300 and 302 receives the same signal from four panels and through its four outputs provides three signals so as to realize three omni-directional patterns with 360 degree coverage. The antenna structure provides dual polarizations (+45 and −45 degree) resulting in a 6×6 MIMO arrangement.

Each panel 282 through 288 includes four antenna elements. To this end, panel 282 includes antenna elements 282*a* through 282*d*, panel 284 includes antenna elements 284*a* through 284*d*, panel 286 includes antenna elements 286*a* through 286*d*, and panel 288 includes antenna elements 288*a* through 288*d*.

In accordance with one embodiment of the invention, beam forming network (BFN) 300 provides signals to +45 degree polarization ports of the four panels 282, 284, 286, and 288, and beam forming networks (BFN) 302 provides signals to −45 degree polarization ports of the four panels 282, 284, 286, and 288, so as to accomplish a dual polarization arrangement.

Advantageously, in accordance with this embodiment of the invention in reference with FIGS. 9A and 9B, it is possible to configure a 6×6 MIMO antenna system in a substantially smaller space than what would have been required for an 6×6 MIMO antenna system in accordance with T-splitter type beam forming networks of the prior art for a 2×2 MIMO antenna system.\

In accordance with various embodiments of the invention, the antenna elements are dipole antenna elements (also known as cross-dipole element, or printed dipole antennas). A dipole antenna is a narrowband (15%). In order to provide better bandwidth (15-50%) and reduce manufacture cost, suspended metal patches or rings in air through using dielectric spacers are used above a ground plane.

In accordance with yet other embodiments, the antenna elements are advantageously, patch antenna element (also known as microstrip patch antennas, or printed patch antennas). Patch antennas exhibit a low profile, and are light weight, inexpensive, easily manufactured, mechanically rugged, and easily integrated with other circuits. Patch element is a narrowband (1-5%) element and a wideband element is fabricated by etching the antenna element on printed circuit board (PCB) with a continuous metal layer bonded to the opposite side of the substrate which forms a ground plane. Common microstrip antenna radiator shapes are square, rectangular, circular and elliptical, but any continuous shape is possible. Common feeding networks to microstrip patch antennas are microstrip edge feed, probe feed, slot-coupled feed (SCP, used for this application), capacitive-coupled feed (CCP), and more. In order to provide better bandwidth (15-50%) and reduce manufacture cost, a suspended metal patch in air through using dielectric spacers is used above a ground plane.

Figure 10A:
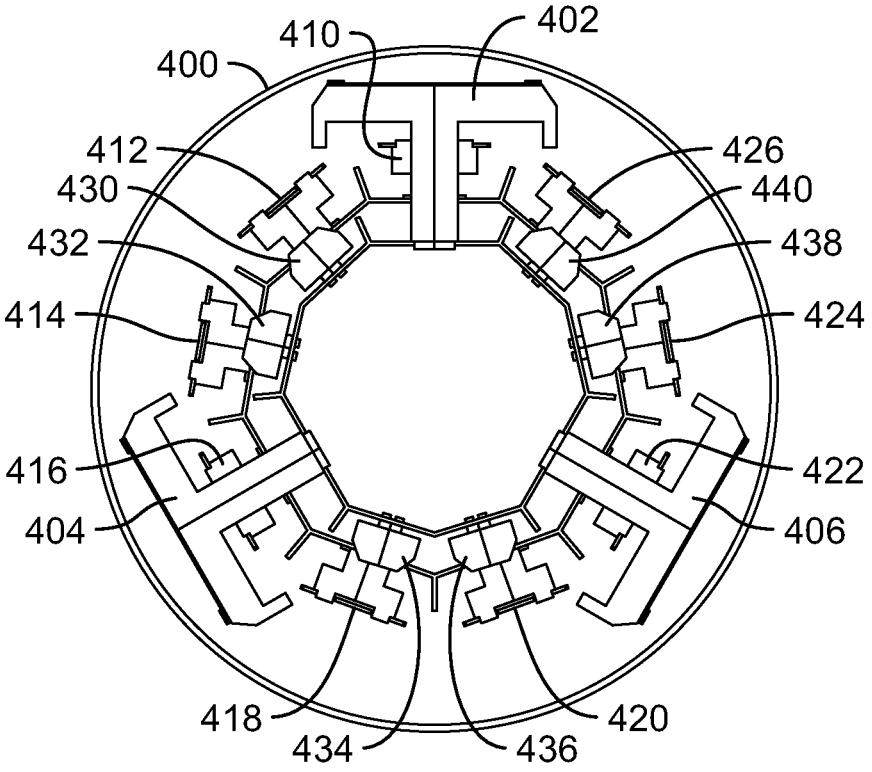
FIGS. 10A is a cross section view of a quad-band cellular base antenna structure (three-column 6×6 MIMO at LB band with two 3×3 Butler matrix configuration) and FIG. 10B is a side view of the quad-band antenna.
Figure 10B:
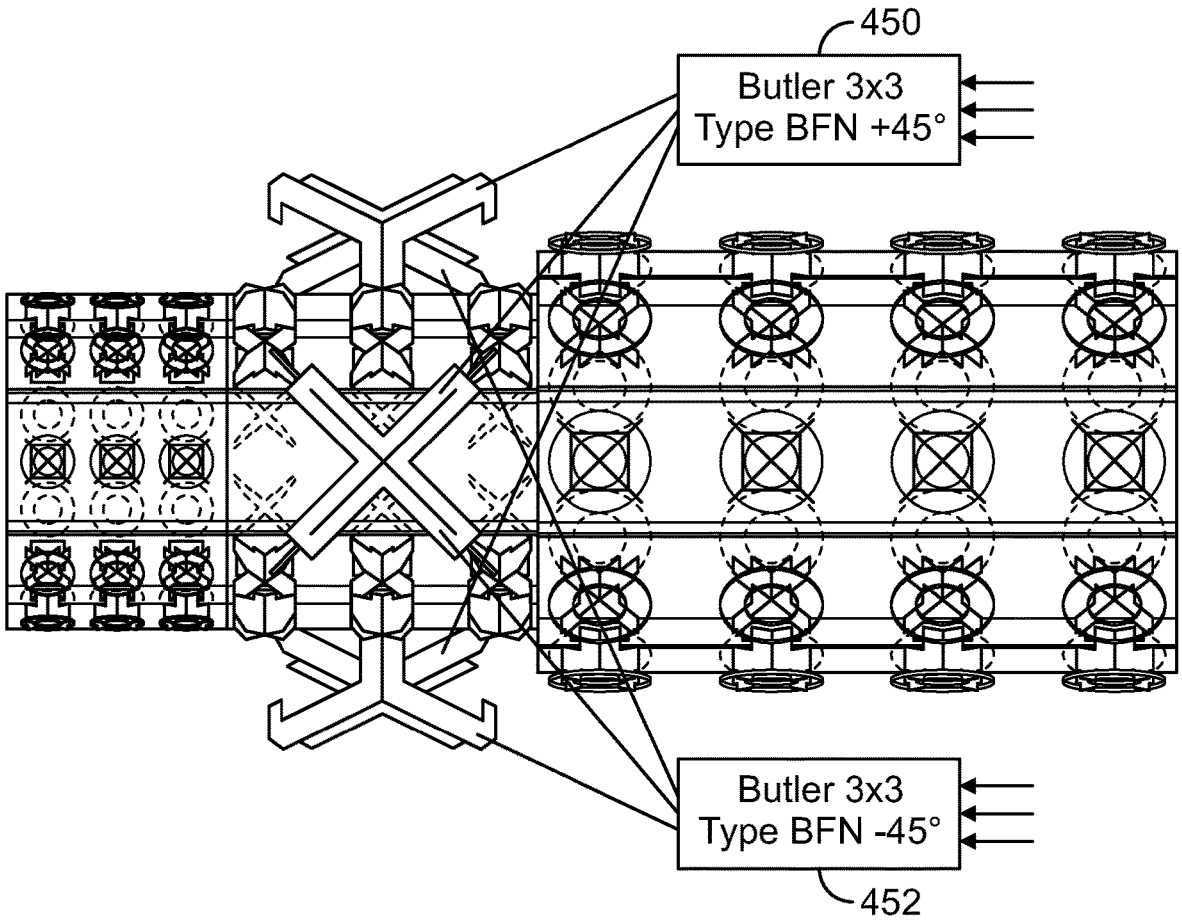

The above embodiments can be employed in antennas that are required to operate in a multi-band arrangement (either stacked together or interleaved each other). FIGS. 10A and 10B illustrate antenna 400 having a quad-band omni-directional beam circular array with multi-band Butler type beam forming networks (BFN) occupying an advantageously limited space. For commonly used omni-directional circular array, an exemplary set of the working frequency bands cover four frequency ranges: Low band (LB): 894-960 MHz, Mid band (MB): 1695-2690 MHz, CBRS band: 3400-3800 MHz, and LAA band: 5150-5925 MHz.

As illustrated in FIG. 10A, a cellular base antenna structure 400 with following panels are employed to provide a quasi-omnidirectional pattern in a given cell of a cellular network: three panels 402, 404, and 406 for LB band, nine panels 410, 412, 414, 416, 418, 420, 422, 424 and 426 for MB band, six panels 430, 432, 434, 436, 348 and 440 for CBRS/LAA band. In order to locate the maximum number of ports in the limited space, the MB panels, CBRS panels and LAA panels are stacked vertically, and CBRS elements share the same panels with LAA elements. On the other hands, the LB panels are interleaved with CBRS/LAA panels. FIG. 10B is a side view of the quad-band MIMO antenna, whereas FIG. 10A is a cross section view of the quad-band antenna.

For simplicity, here only the Butler type beam forming networks at LB band are described, and the T-splitter type beam forming networks at MB, CBRS, and LAA bands are used, although the invention is not limited in scope to such an embodiment. For example, based on the previous described approach, the Butler type beam forming networks at MB, CBRS, and LAA bands could be deducted accordingly by those skilled in the art.

Antenna 400 includes two Butler type beam forming networks (BFN) 450 and 452 at LB band. Each beam forming network (BFN) is a Butler 3×3 with 90 degree hybrid couplers, employing three-input three outputs to realize three omni-directional patterns with 360 degree coverage As illustrated in FIG. 10, BFNs 450 and 452 provide signals to a three panel antenna with dual polarization patterns (+45 and −45 degree), each panel 402, 404, and 406 having one antenna element.

In general, and in accordance with various other embodiments of the invention, based on a desired beam performance and different isolation values between ports, an m×m MIMO structure can be employed for lesser port applications. For example, for an 8×8 MIMO, a 6×6 MIMO application can be used where 2 ports of the 8×8 MIMO are not used. As desired, a 4×4 MIMO application can be used where 4 ports of the 8×8 MIMO are not used, or even a 2×2 MIMO application can be used where 6 ports of the 8×8 MIMO are not used.

The design of the beam forming networks (BFN) employing Butler matrix arrangement is explained hereinafter. The conventional Butler matrix N×N, where N is any integral power of 2 (i.e., $=2^n$), was introduced by J. Butler in 1961 in J. Butler and R. Howe, "Beamforming matrix simplifies design of electronically scanned antennas", Electronic Design, Vol. 9, pp. 170-173, 1961, incorporated herein by reference. The basic feature of the Butler matrix is the uniform amplitude distribution and constant phase increment between output antenna ports for each input beam port, and orthogonal beams are formed to point the corresponding angle. For N=2, 4, and 8, as shown in Table I, the phase increments between antenna ports are well known.

By introducing the non-equal amplitude (i. e., not 3 dB) hybrid coupler (HC), the Butler matrix N×N with orthogonal beams can be realized for any N as described in L. G. Sodin, "Method of synthesizing a beam-forming device for the N-Beam and N-Element Array Antenna, for any N," IEEE Trans. Antennas Propag., vol. 60, no. 4, pp. 1771-1776, 2012 and incorporated herein by reference.

As shown in Table I, there is a broadside beam (i. e., zero phase increment) for odd number N. By subtracting a constant phase at antenna ports, a new set of Butler matrix J×N, where J=N−1, is introduced and their corresponding phase increments are shown in the right column of Table I.

TABLE I

PHASE OF THE BUTLER MATRIX (N = 2 − 8).

| N × N | Phtise increment | J × N | Phase Increment |
|---|---|---|---|
| 2 × 2 | ±π/2 | 1 × 2 | 0 |
| 3 × 3 | 0, ±2π/3 | 2 × 3 | ±π/3 |
| 4 × 4 | ±π/4, ±3π/4 | 3 × 4 | 0, ±2π/4 |
| 5 × 5 | 0, ±2π/5, ±4π/5 | 4 × 5 | ±π/5, ±3π/5 |
| 6 × 6 | ±π/6, ±3π/6, ±5π/6 | 5 × 6 | 0, ±2π/6, ±4π/6 |
| 7 × 7 | 0, ±2π/7, ±4π/7, ±6π/7 | 6 × 7 | ±π/7, ±3π/7, ±5π/7 |
| 8 × 8 | ±π/8, ±3π/8,±5π/8, ±7π/8 | 7 × 8 | 0, ±2π/8, ±4π/8, ±6π/8 |

For example, for Butler 3×3, the three phase increments for three inputs (R, C, and L) are 0°, ±120° (or ±2π/3), where R, C, L stand for right, center, and left; for Butler 4×4, the four phase increments for four inputs (R2, R1, L1, and L2) are ±45° (or ±π/4) and ±135° (or ±3π/4), which are corresponding to the following phase relationship: 0°, ±45°, ±90°, ±135° for R1/L1 ports and 0°, ±135°, ±270°, ±405° for R2/L2 ports.

Based on the phase increment required by the azimuth beam patterns, a suitable Butler N×N (or J×N, where J=N−1) could be applied to the antenna structure. For example, for three column antennas, the phase increment is 0° and ±120° (or ±2π/3) for Butler 3×3, and ±60° (or ±π/3) for Butler 2×3. For four column antennas, the phase increment is ±45° (or ±π/4) and ±135° (or ±3π/4) for Butler 4×4, and 0°, ±90° (or ±π/2) for Butler 3×4.

Figure 11A:
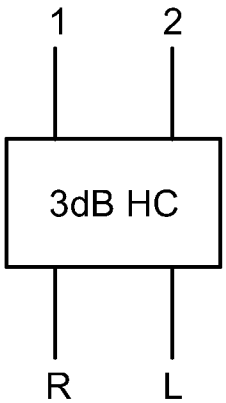
FIGS. 11A, 11B, and 11C illustrate the schematic diagram of Butler 2×2, Butler 3×3, and Butler 4×4 constructed by the HC with 90 degree phase delay.
Figure 11B:
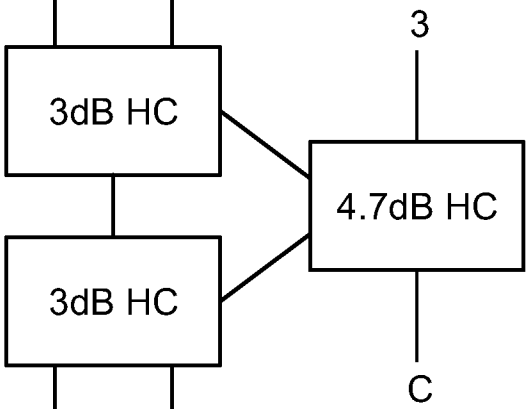
Figure 11C:
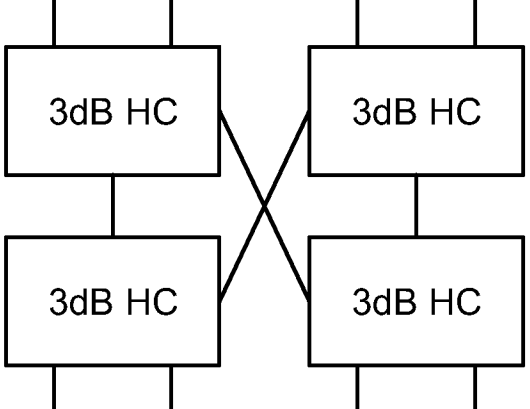

FIGS. 11A, 11B, and 11C illustrate the schematic diagram of Butler 2×2, Butler 3×3, and Butler 4×4 constructed by a hybrid coupler (HC) with 90° phase delay. For Butler 2×2 as shown in FIG. 11A, it is simply a 3 dB hybrid coupler, in which each input (i.e., R or L) delivers signal uniformly to two outputs (i.e., 1 or 2) with 90° phase delay. For Butler 3×3 as shown in FIG. 11B, it consists of two 3 dB hybrid couplers and one 4.7 dB hybrid coupler, in which each input (i.e., R, L or C) delivers signal uniformly to three outputs (i.e., 1, 2 or 3) with specific phase increments (i.e., −120 degree, 0 degree, or +120 degree). For Butler 4×4 as shown in FIG. 11C, it consists of four 3 dB hybrid couplers, in which each input (i.e., R1, R2, L1 or L2) delivers signal uniformly to four outputs (i.e., 1, 2, 3 or 4) with specific phase increments (i.e., −135 degree, −45 degree, +45 degree, or +135 degree).

Figure 12C:
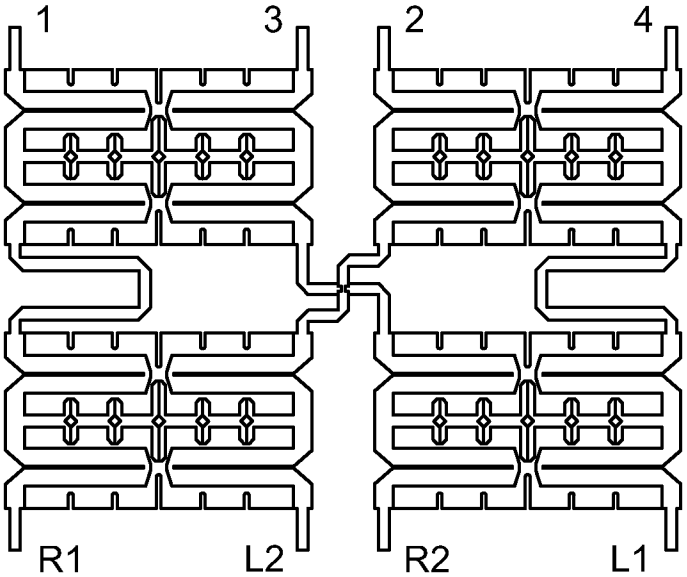
FIGS. 12A, 12B, and 12C illustrate the physical circuit layout of Butler 2×2, Butler 3×3, and Butler 4×4 constructed by the HC with 90 degree phase delay.
Figure 12B:
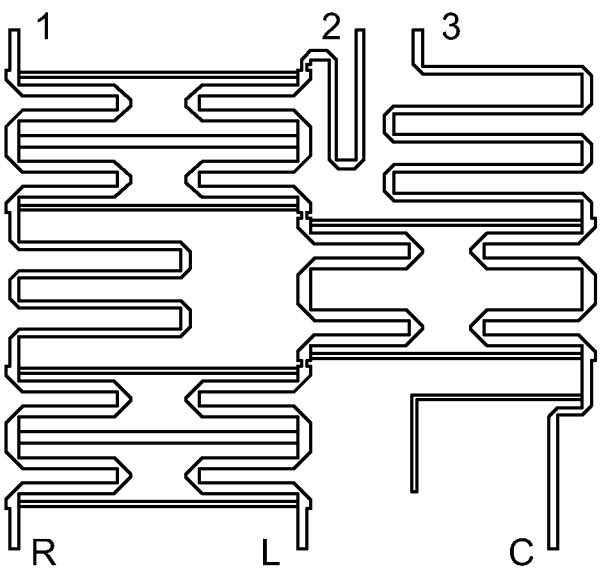
Figure 12A:
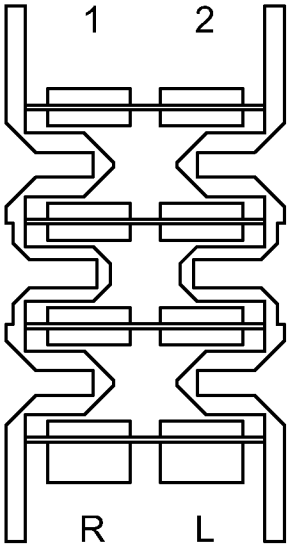

FIGS. 12A, 12B, and 12C illustrate the physical circuit layout of Butler 2×2, Butler 3×3, and Butler 4×4 constructed by the HC with 90 degree phase delay. For Butler 2×2 as shown in FIG. 12A, it is an ultra-wide bandwidth 3 dB branch-type hybrid coupler working at the frequency band of 1.65-2.75 GHz (or 50% bandwidth), in which eight rectangle slots in the ground plane is applied to maintain minimum width of the coupler branch lines.

For Butler 3×3 as shown in FIG. 12B, it consists of two 3 dB branch-type hybrid couplers and one 4.7 dB branch-type hybrid coupler working at the frequency band of Low band (0.65-1.0 GHz, or 40% bandwidth), in which a direct current (DC) grounding attached to the input C is realized through the quarter-wavelength transformer.

For Butler 4×4 as shown in FIG. 12C, it consists of four 3 dB branch-type hybrid couplers working at the frequency band of 0.65-1.0 GHz (or 40% bandwidth), in which coupler line branch-type couplers are applied and the overall layout area of Butler 4×4 is much less than one of Butler 3×3. Also in order to avoid additional components such as low-loss cross-over, a high performance via cross-over is applied through the transmission line with two vias located at ground slot.

Figure 13A:
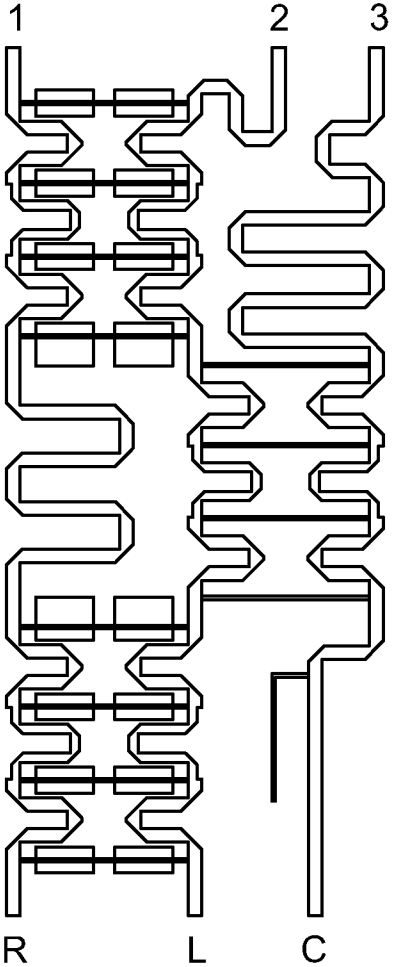
FIGS. 13A, 13B, and 13C illustrate the physical circuit layout of Butler 3×3 working at different frequency bands of Mid-band, CBRS-band, and LAA-band.
Figure 13B:
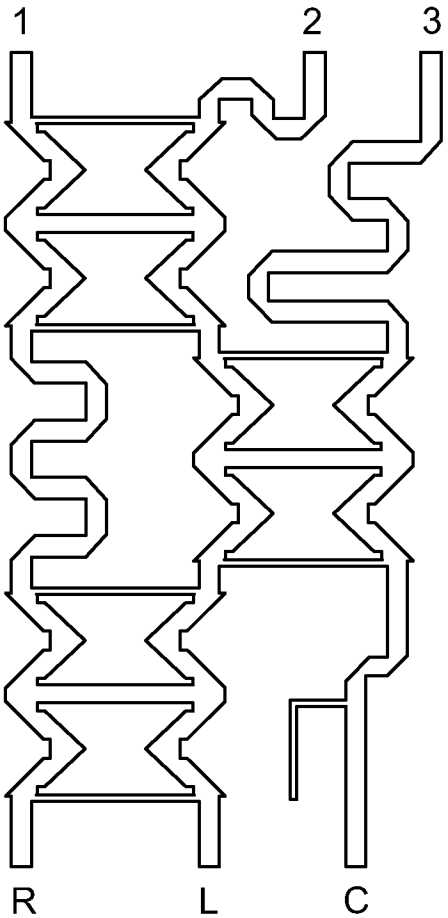
Figure 13C:
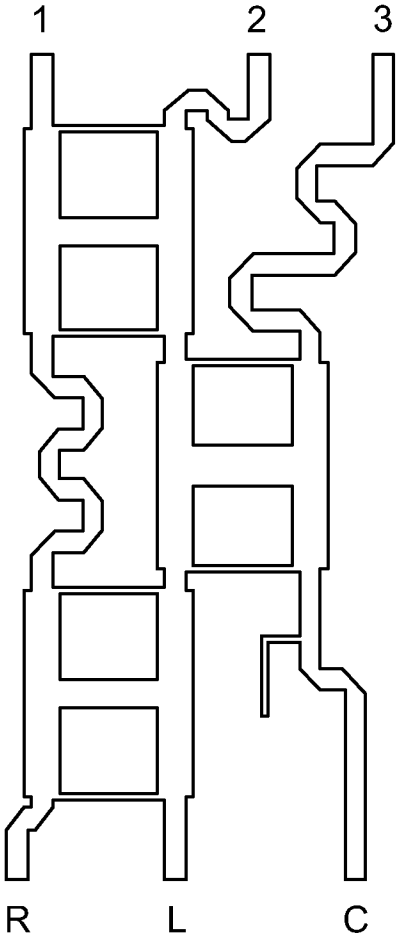

FIGS. 13A, 13B, and 13C illustrate the physical circuit layout of Butler 3×3 with DC grounding attached at input C working at different frequency bands of Mid-band, CBRS-band, and LAA-band. For Butler 3×3 as shown in FIG. 13A, it consists of two 3 dB branch-type hybrid couplers as shown in FIG. 12A and one 4.7 dB branch-type hybrid coupler working at the frequency band of Mid-band (1.65-2.75 GHz, or 50% bandwidth). For Butler 3×3 as shown in FIG. 13B, it consists of two 3 dB branch-type hybrid couplers and one 4.7 dB branch-type hybrid coupler working at the frequency band of CBRS-band (3.2-3.9 GHz, or 20% bandwidth). For Butler 3×3 as shown in FIG. 13C, again it consists of two 3 dB branch-type hybrid couplers and one 4.7 dB branch-type hybrid coupler working at the frequency band of LAA-band (5.1-6.0 GHz, or 16% bandwidth).

For Butler 3×3 as shown in FIG. 12B, FIG. 13A, FIG. 13B, and FIG. 13C, due to the nature of the hybrid coupler with quarter wavelength branch line, the layout area of Butler working at higher frequency bands such as CBRS-band and LAA-band is much less than one working at lower frequency bands such as Low-band and Mid-band.

Figure 14A:
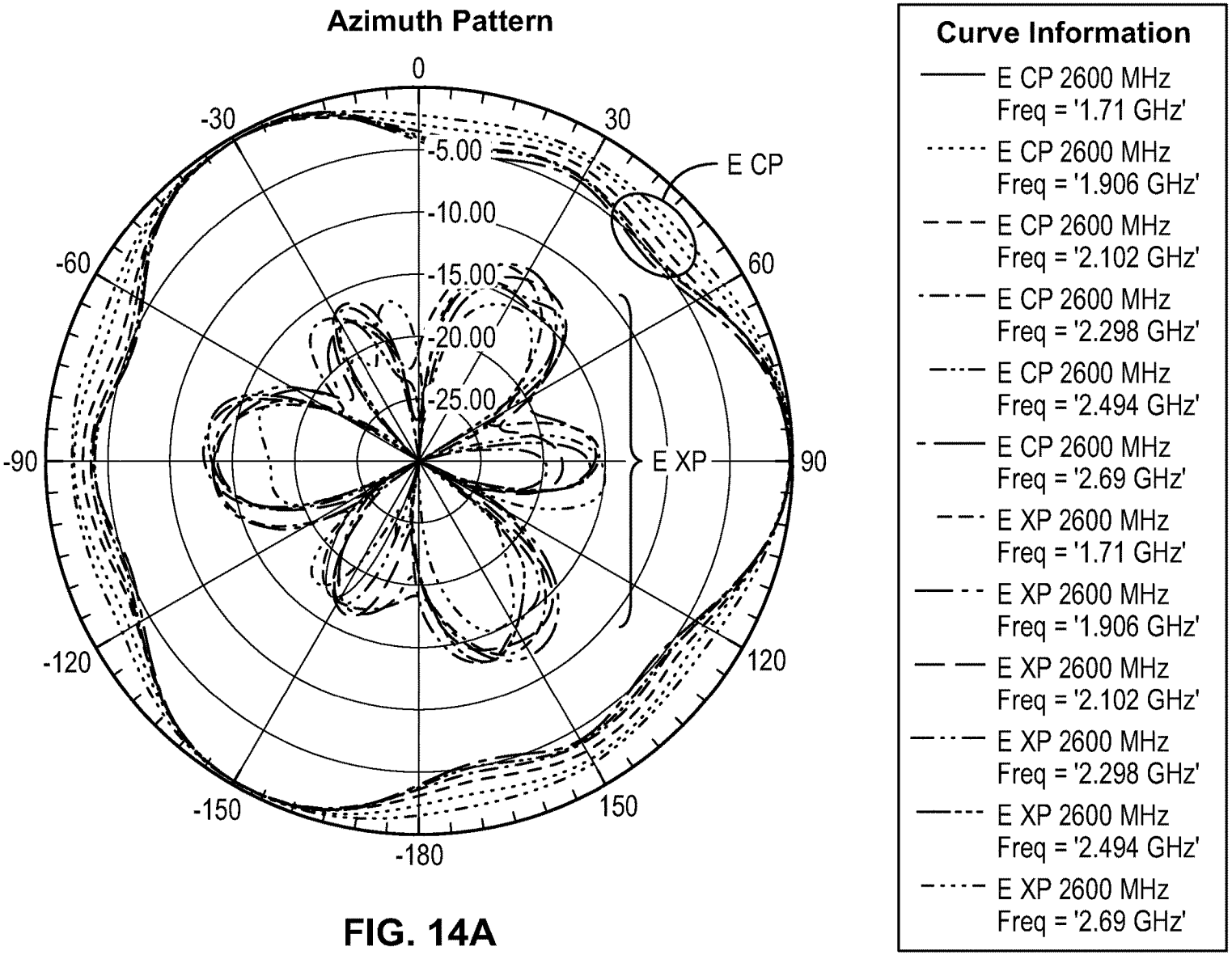
FIGS. 14A and 14B illustrate the azimuth patterns of the three-column antenna as shown in FIG. 3 with Butler 3×3 illustrated in FIG. 13A.
Figure 14B:
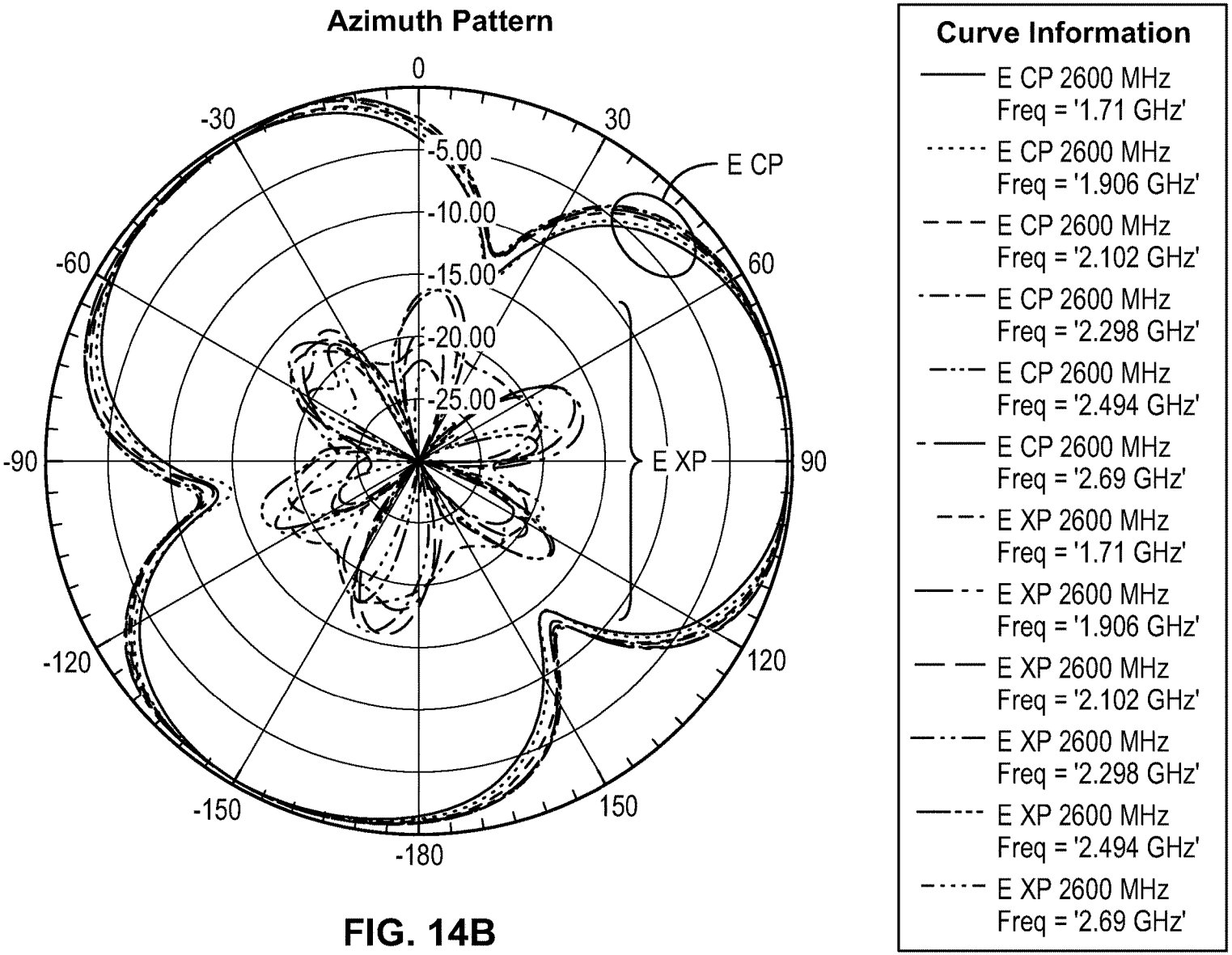

FIGS. 14A and 14B illustrate the azimuth patterns of the three-column antenna as shown in FIG. 3 as antenna 40 operates at Mid-band generated by applying the Butler 3×3 illustrated in FIG. 13A. Accordingly, FIG. 14A is the omni-directional co-pol and cross-pol azimuth patterns of the antenna over the whole range of Mid-band (1.695-2.69 GHz) when C port of Butler 3×3 is excited, and FIG. 14B is the omni-directional co-pol and cross-pol azimuth patterns of the antenna over the whole range of Mid-band (1.695-2.69 GHz) when R port or L port of Butler 3×3 is excited.

Figure 15A:
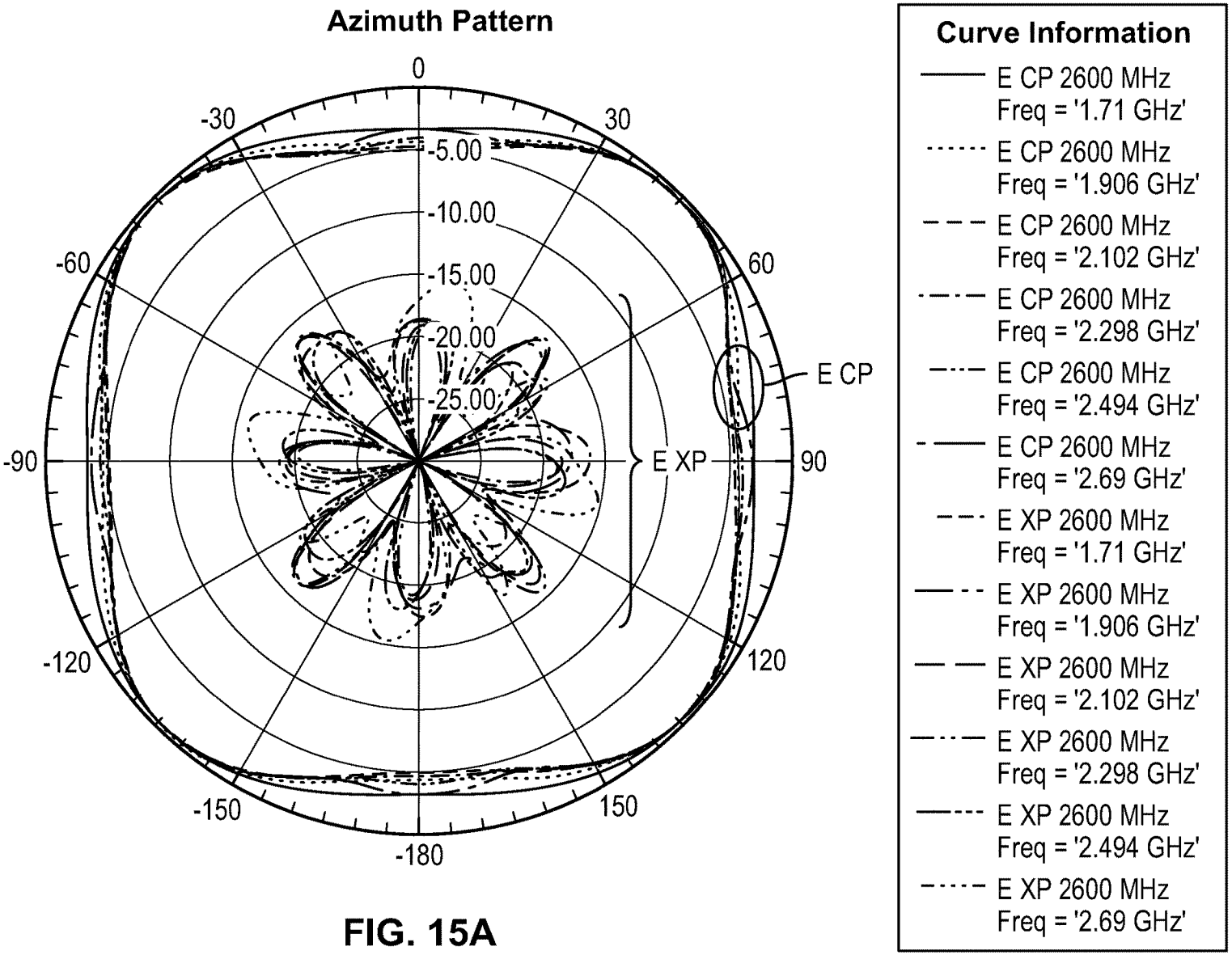
FIGS. 15A and 15B illustrate the azimuth patterns of the four-column antenna as shown in FIG. 9 with Butler 3×4 illustrated in Table 1.
Figure 15B:
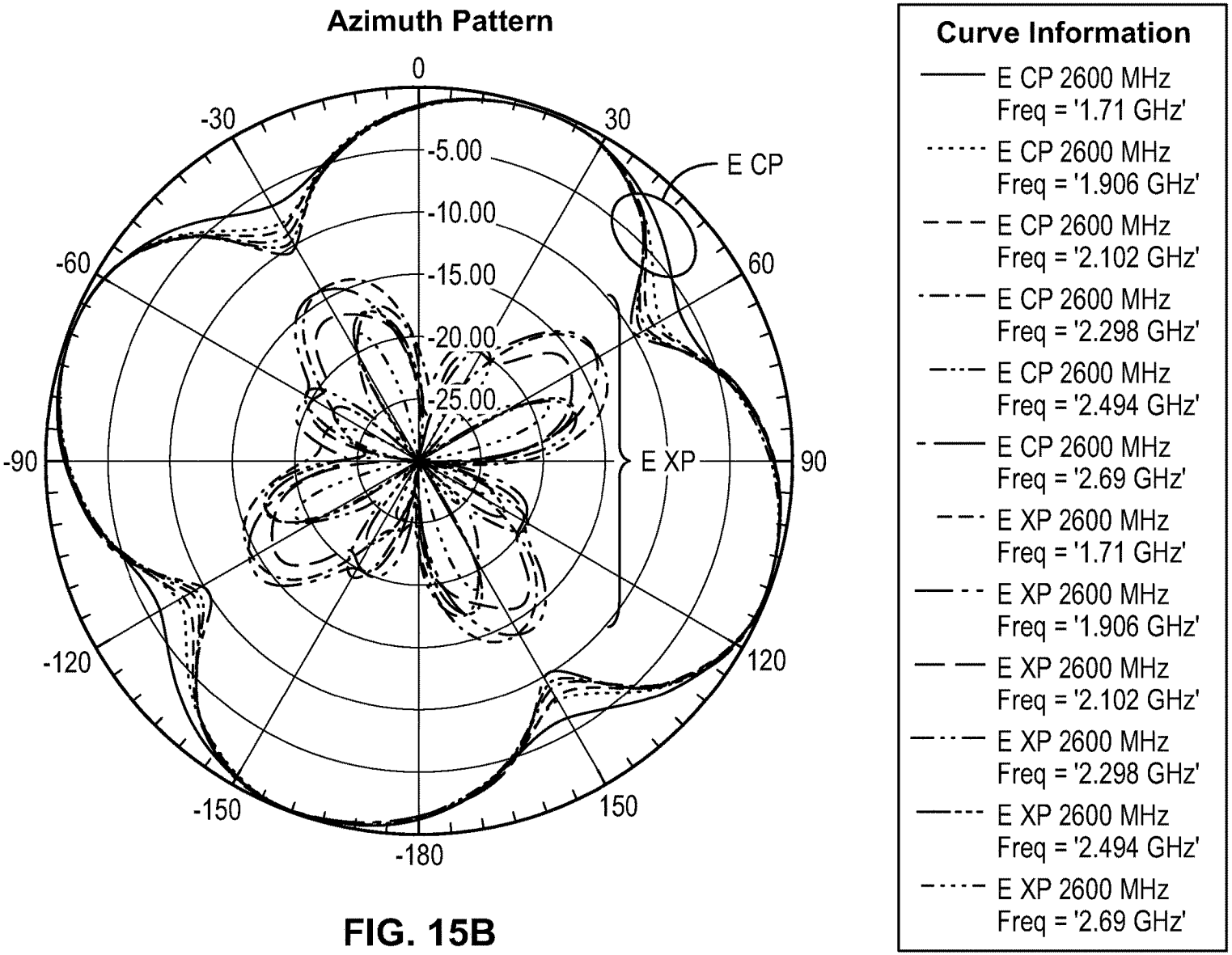

FIGS. 15A and 15B illustrate the azimuth patterns of the four-column antenna as shown in FIG. 9 as antenna 200 operates at Mid-band generated by applying Butler 3×4 illustrated in Table 1. Accordingly, FIG. 15A is the omni-directional co-pol and cross-pol azimuth patterns of the antenna over the whole range of Mid-band (1.695-2.69 GHz) when C port of Butler 3×4 with 0° phase increment is excited, and FIG. 15B is the omni-directional co-pol and cross-pol azimuth patterns of the antenna over the whole range of Mid-band (1.695-2.69 GHz) when R port or L port of Butler 3×4 with ±90° phase increment is excited.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

We claim:

1. An omnidirectional MIMO antenna system comprising:

a multi-panel antenna, each panel including a plurality of antenna elements;

a plurality of beam forming networks employing Butler matrices each Butler matrix having the same number of input ports and output ports, wherein the total number of said input ports of said Butler matrices is equal to the number of ports of said MIMO antenna, each of said input ports receiving the same signal; and each of said output ports of each of said Butler matrices is coupled to an antenna element within the plurality of said antenna elements, such that said multi-panel antenna exhibits a quasi-omnidirectional beam pattern.

2. The omnidirectional MIMO antenna system according to claim 1, wherein said antenna panels include dual polarization ports, and said beam forming networks provide signals to a first polarization port of each panel and to a second polarization port of said panel.

3. The omnidirectional MIMO antenna system according to claim 2, wherein said first polarization port receives signals for transmitting at +45° polarization pattern and said second polarization port receives signals for transmitting at −45° polarization pattern.

4. The omnidirectional MIMO antenna system in accordance with claim 1, wherein said antenna elements are patch antenna elements.

5. The omnidirectional MIMO antenna system in accordance with claim 1, wherein said antenna elements are dipole antenna elements.

6. An omnidirectional MIMO antenna system comprising:

a multi-panel antenna, having m×N panels, each panel including a plurality of antenna elements forming a circular array, wherein m and N are integers equal or larger than 1;

a plurality of 2N beam forming networks each employing an m×m Butler matrix each Butler matrix having the same number of input ports and output ports, wherein the number of panels of said multi-panel antenna is equal to m×N, each of said input ports receiving the same signal; and each of said output ports of each of said Butler matrices is coupled to an antenna element within the plurality of said antenna elements, such that said multi-panel antenna operates as a 2(m)N×2m(N) MIMO antenna exhibiting a quasi-omnidirectional beam pattern.

7. The omnidirectional MIMO antenna system according to claim 6, wherein said antenna panels include dual polarization ports, and said beam forming networks provide signals to a first polarization port of each panel and to a second polarization port of said panel.

8. The omnidirectional MIMO antenna system according to claim 7, wherein said first polarization port receives signals for transmitting at +45° polarization pattern and said second polarization port receives signals for transmitting at −45° polarization pattern.

* * * * *